US007447454B2

(12) United States Patent
Nishimura et al.

(10) Patent No.: US 7,447,454 B2
(45) Date of Patent: Nov. 4, 2008

(54) IMAGE FORMING APPARATUS AND PROCESS CARTRIDGE

(75) Inventors: Soichiro Nishimura, Handa (JP); Hideaki Deguchi, Nagoya (JP); Satoru Ishikawa, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/954,469

(22) Filed: Oct. 1, 2004

(65) Prior Publication Data

US 2005/0100357 A1 May 12, 2005

(30) Foreign Application Priority Data

Oct. 2, 2003 (JP) ..... 2003-344653
Dec. 25, 2003 (JP) ..... 2003-429956

(51) Int. Cl.
*G03G 15/16* (2006.01)

(52) U.S. Cl. ..... 399/66; 399/107; 399/314

(58) Field of Classification Search ..... 399/66, 399/98, 107, 279, 298, 313, 314, 353, 354, 399/99; 74/431, 469, 458.5, 413, 414
See application file for complete search history.

(56) References Cited

U.S. PATENT DOCUMENTS 5,532,799 A 7/1996 Watanabe et al.
5,634,178 A * 5/1997 Sugiura et al. ..... 399/107
5,701,562 A * 12/1997 Araki et al. ..... 399/279
5,761,574 A * 6/1998 Murooka ..... 399/66
5,995,785 A * 11/1999 Kato et al.
6,205,299 B1 * 3/2001 Kusaka et al.
6,304,735 B1 10/2001 Nishimura et al.
6,374,073 B2 4/2002 Ozaki et al.
6,470,161 B2 * 10/2002 Fujishiro et al.
6,473,107 B2 10/2002 Koga et al.
6,650,861 B2 * 11/2003 Inukai et al. ..... 399/314
6,795,669 B2 * 9/2004 Yamauchi et al. ..... 399/313

FOREIGN PATENT DOCUMENTS

JP A 60-83068 5/1985
JP U 61-88161 6/1986
JP 01316774 A * 12/1989
JP A 5-197319 8/1993
JP A 6-35279 2/1994
JP A 7-239613 9/1995
JP A 10-91015 4/1998
JP A 11-305621 11/1999
JP 2000056594 A * 2/2000
JP A 2001-5357 1/2001
JP A 2001-159839 6/2001
JP A 2002-14552 1/2002
JP 2002156842 A * 5/2002
JP A 2002-148911 5/2002

* cited by examiner

*Primary Examiner*—David M. Gray
*Assistant Examiner*—Laura K Roth
(74) *Attorney, Agent, or Firm*—Oliff & Berridge, PLC

(57) ABSTRACT

An image forming apparatus includes: a transfer member that transfers a developer image onto a transfer medium to form an image on the transfer medium; a bias applying unit that applies a transfer bias to the transfer member; and a bias control unit that controls the transfer bias to be applied to the transfer member by the bias applying unit, wherein a longitudinal length of the transfer member is formed to be shorter than a width of the transfer medium having a maximum width on which the image is to be formed with the image forming apparatus.

32 Claims, 12 Drawing Sheets

IMAGE FORMING APPARATUS AND PROCESS CARTRIDGE

BACKGROUND OF THE INVENTION

1. Field of the Invention

The present invention relates to an image forming apparatus such as a laser printer, and a process cartridge to be detachably attached to the image forming apparatus. The present invention also relates to an image forming apparatus that is configured so that a developer remaining on an image carrier after transferring is collected by a developing unit.

2. Description of the Related Art

In an image forming apparatus such as a laser printer, a process cartridge including a developing roller which carries toner, a photoconductor drum which is disposed opposite the developing roller and on which an electrostatic latent image is formed, and a transfer roller which is disposed opposite the photoconductor drum to transfer a toner image onto a sheet is detachably attached.

On the photoconductor drum, a toner is supplied from the developing roller, and an electrostatic latent image is developed, whereby a toner image is carried. To the transfer roller, a transfer bias for transferring the toner image onto a sheet is applied. The toner image carried on the photoconductor drum is transferred onto a sheet while the sheet passes between the photoconductor drum and the transfer roller, whereby the image is formed on the sheet.

In such a process cartridge, the length in the axial direction of the transfer roller for receiving the sheet is formed to be longer than the width of the sheet with a maximum width on which an image can be formed with the image forming apparatus, and for example, it is generally known that the contact length between the transfer roller and drum is set to be longer than the maximum sheet width (for example, see JP-A-6-035279).

On the other hand, an electrophotographic printer apparatus has been conventionally known as an image forming apparatus. In this type of image forming apparatus, a photoconductor as an image carrier is exposed to form an electrostatic latent image on the photoconductor, and forms a developer image on the photoconductor by developing the electrostatic latent image by applying a charged developer (toner, etc.) to the photoconductor.

When the developer is applied, a developing bias is supplied to a developer carrier (developing roller, etc.) of a development unit that is made to contact with the photoconductor to form an electrical field in a direction of moving the developer toward the photoconductor between the developer carrier and the photoconductor, and then the developer is applied. Then, a sheet is conveyed between the photoconductor and the transfer member (transfer roller, etc.) disposed opposite the photoconductor, and a transfer bias is supplied to the transfer member, whereby an electrical field is formed between the transfer member and the photoconductor in the direction of moving the developer toward the sheet, and a developer image carried by the photoconductor is transferred onto the sheet.

As this type of image forming apparatus, there is known an image forming apparatus which collects a developer remaining on the image carrier after transferring by using an exclusive developer collector (cleaner), and a cleaner-less image forming apparatus which does not have the exclusive developer collector but collects the developer remaining on the image carrier after transferring by a development unit.

As a cleaner-less image forming apparatus, there is known an apparatus having a paper powder removal device for removing paper powder from the image carrier (see JP-A-2001-005357).

In the cleaner-less image forming apparatus, when a developer remaining on the image carrier after transferring is collected by the development unit, there is a possibility that the development unit also collects paper powder adhering to the image carrier, simultaneously. In this case, the paper powder is mixed into the development unit, resulting in deterioration in development performance and lowering in quality of printed images. The paper powder removal device is provided inside the image forming apparatus for the purpose of preventing the paper powder adhering to the image carrier being collected and this deteriorates the development performance and quality lowering of printed images.

In detail, a paper powder removal device having a conductive brush is known. To the brush, a voltage for selectively adsorbing only the paper powder without adsorbing the developer is applied. The brush also functions to disperse the developer remaining on the image carrier after transferring so that the remaining developer is easily collected by the development unit, so that the brush is widely used for the paper powder removal device.

SUMMARY OF THE INVENTION

When the length in the axial direction of the transfer roller is formed to be longer than the width of the sheet with a maximum width, when a toner image is transferred onto a sheet with the maximum width, in particular, a sheet with a width narrower than the sheet with the maximum width, on both ends in the width direction of the sheet, there is a range in which the photoconductor drum and the transfer roller come into direct contact with each other. In this case, in this range, a transfer bias is not applied to the sheet and a transfer current leaks. Therefore, in particular, for a sheet with a narrow width, considering the leak, the transfer bias must be set so as to increase the transfer current. Furthermore, in an environment with a high temperature and a low humidity, the resistance of the sheet increases and the resistance of the transfer roller lowers, so that the transfer current more easily leaks. Therefore, in such an environment with a high temperature and a low humidity, the transfer bias must be set so as to increase the transfer current.

On the other hand, the transfer current that the photoconductor drum can withstand is limited, and if the transfer current excessively increases, the photoconductor drum is damaged.

Particularly, when an image is transferred onto a sheet with a narrow width in an environment with a high temperature and a low humidity, the necessary transfer current value exceeds the transfer current value that the photoconductor drum can withstand in some cases. In such a case, if the transfer current value is lowered to prevent the photoconductor drum from being damaged, a transfer failure occurs, and on the other hand, when the transfer current value is raised to prevent the transfer failure, the photoconductor drum is damaged.

Therefore, one of objects of the invention is to provide an image forming apparatus which can apply a proper transfer bias according to ease of occurrence of transfer bias leak, and can reduce damage on the apparatus caused by excessive application of a transfer current while reducing a transfer failure caused by shortage in application of a transfer current, and to provide a process cartridge to be attached to the image forming apparatus.

On the other hand, in the above described type of a conventional paper powder removal device, when the brush is used for a long period of time, there is a possibility that paper powder accumulated on the brush splatters from both ends of the brush along the rotation axis of the image carrier, adheres to the electrodes of the charger (discharging wire, etc.) and causes abnormal discharge from the charger. Furthermore, there is a possibility that paper powder enters from the edge of a region on the image carrier from which the paper powder removal device can remove paper powder and the paper powder that has entered harmfully influences the charger.

Therefore, another one of objects of the invention is to provide an image forming apparatus which can restrain abnormal discharge due to paper powder at the time of charging by the charger.

According to a first aspect of the invention, there is provided an image forming apparatus including: a transfer member that transfers a developer image onto a transfer medium to form an image on the transfer medium; a bias applying unit that applies a transfer bias to the transfer member; and a bias control unit that controls the transfer bias to be applied to the transfer member by the bias applying unit, wherein a longitudinal length of the transfer member is formed to be shorter than a width of the transfer medium having a maximum width on which the image is to be formed with the image forming apparatus.

According to a second aspect of the invention, there is provided a process cartridge including: a developer carrier that carries a developer; an image carrier that is disposed opposite the developer carrier and carries a developer image; a transfer member that transfers the developer image onto a transfer medium, and is detachably attached to an image forming apparatus; and a receiving member that receives the developer adhering to both longitudinal ends of the image carrier from the developer carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal ends of the transfer member, wherein the receiving member is disposed below the image carrier so as to be opposite each other at the longitudinal ends of the image carrier that are not opposite the longitudinal ends of the transfer member.

According to a third aspect of the invention, there is provided an image forming apparatus including: a developer carrier that carries a developer; an image carrier that is disposed opposite the developer carrier and carries the developer image; a transfer member that transfers a developer image onto a transfer medium; and a receiving member that receives a developer adhering to both longitudinal ends of the image carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends thereof is not opposite the longitudinal ends of the transfer member, and wherein the receiving member is disposed below the image carrier so as to be opposite the transfer member and at the longitudinal end of the image carrier that are not opposite the longitudinal ends of the transfer member.

According to a fourth aspect of the invention, there is provided a process cartridge including: an image carrier that carries a developer image; a transfer member that transfers a developer image onto a transfer medium; a shaft member that supports the transfer member; and a bearing member that rotatably supports the shaft member and is detachably attached to an image forming apparatus, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal ends of the transfer member, and wherein the bearing member is disposed below the image carrier so as to be opposite the image carrier at the longitudinal ends of the image carrier that are not opposite the longitudinal ends of the transfer member.

According to a fifth aspect of the invention, there is provided an image forming apparatus including: an image carrier on which a developer image is carried; a transfer member that transfers a developer image onto a transfer medium; a shaft member that supports the transfer member; and a bearing member that rotatably supports the shaft member, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal end of the transfer member, and wherein the bearing member is disposed below the image carrier so as to be opposite the image carrier at the longitudinal ends of the image carrier that are not opposite the longitudinal ends of the transfer member.

According to a sixth aspect of the invention, there is provided a process cartridge including: an image carrier that carries a developer image; a second driving member that is provided at the longitudinal end of the image carrier and drives the image carrier; a transfer member that transfers a developer image onto a transfer medium; a shaft member that supports the transfer member; a first driving member that is provided at one end of the shaft member so as not to rotate relatively to the shaft member and drives the transfer member; and a power input member that inputs power into the second driving member, and is detachably attached to an image forming apparatus, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap in the longitudinal direction of the transfer member.

According to a seventh aspect of the invention, there is provided an image forming apparatus including: an image carrier that carries a developer image; a second driving member that is provided on the longitudinal end of the image carrier and drives the image carrier; a transfer member that transfers the developer image onto a transfer medium; a shaft member that supports the transfer member; a first driving member that is provided on one end of the shaft member so as not to rotate relatively to the shaft member and drives the transfer member; and a power input member that inputs power into the second driving member, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap in the longitudinal direction of the transfer member.

According to an eighth aspect of the invention, there is provided an image forming apparatus including: an image carrier that is rotatably provided; a charging unit that is disposed opposite the image carrier, and charges a charging target region on a surface of the image carrier; an exposure unit that exposes the image carrier at an exposure position positioned at a downstream side in the rotation direction of the image carrier than the charging unit to form an electrostatic latent image on the image carrier; a developing unit that is disposed opposite the image carrier at the downstream side in the rotation direction of the image carrier than the exposure position, and develops an electrostatic latent image that is formed on the image carrier by the exposure unit by applying a developer with charge to form a developer image on the image carrier; a transfer unit that is disposed opposite the image carrier at the downstream side in the rotation direction of the image carrier than the developing unit, and transfers the developer image formed on the image carrier onto a transfer medium; and a paper powder removal unit that is disposed opposite the image carrier at a position downstream in the rotation direction of the image carrier than the transfer position of the transfer unit and upstream than the charging unit, and removes paper powder adhering to the image carrier from the image carrier, wherein the transfer unit collects a developer remaining on the image carrier after transferring by the transfer unit, and wherein a paper powder removal region from which the paper powder removal unit removes paper powder on the image carrier is set wider in the rotation axis direction of the image carrier than the charge target region.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
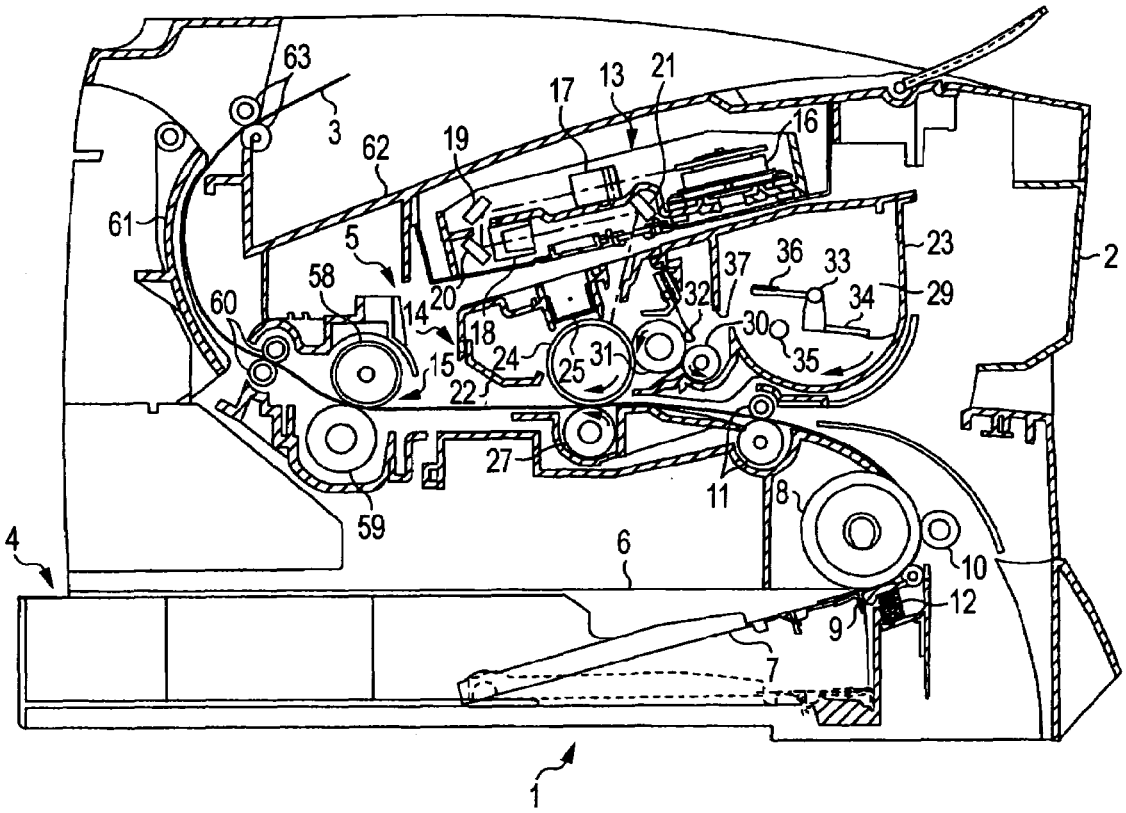
FIG. 1 is a main part side sectional view showing a first embodiment of the laser printer as an image forming apparatus of the invention.

FIG. 1 is a main part side sectional view showing a first embodiment of a laser printer as an image forming apparatus of the invention. In FIG. 1, the laser printer 1 includes a feeder part 4 for feeding a sheet 3 as a transfer medium and an image forming part 5 for forming an image on the fed sheet 3 inside a main body casing 2.

The feeder part 4 includes a paper feed tray 6 to be detachably attached to the bottom inside the main body casing 2, a sheet pressing plate 7 provided inside the paper feed tray 6, a sheet feed roller 8 and a paper feed pad 9 provided above one end of the paper feed tray 6, a paper powder removal roller is 10 disposed opposite the sheet feed roller 8, and a resist roller 11 provided at the opposite side of the paper powder removal roller 10 with respect to the sheet feed roller 8.

The sheet pressing plate 7 is provided so that a sheet 3 can be stacked thereon, and supported in a manner enabling it to swing on the end more distant from the sheet feed roller 8, whereby the nearer end becomes movable vertically. Furthermore, the sheet pressing plate 7 is pressed upward by a spring that is not shown from the back side. Therefore, as the amount of stack of the sheet 3 increases, the sheet pressing plate 7 is made to swing downward around the end more distant from the sheet feed roller 8 against the spring pressing force.

The sheet feed roller 8 and the paper feed pad 9 are disposed opposite each other, and the paper feed pad 9 is pressed toward the sheet feed roller 8 by a spring 12 provided on the back side of the paper feed pad 9.

The top sheet 3 on the sheet pressing plate 7 is pressed toward the sheet feed roller 8 by a spring that is not shown from the back side of the sheet pressing plate 7 and sandwiched between the sheet feed roller 8 and the paper feed pad 9 by rotation of the sheet feed roller 8, and then fed one by one.

The fed sheet 3 is removed of paper powder by the paper powder removal roller 10 and then conveyed to the resist roller 11. The resist roller 11 has a pair of rollers, and conveys the sheet 3 to a transfer position of the image forming part 5 (between a drum main body 40 of a photoconductor drum 24 described later and the roller member 45 of the transfer roller 27) after applying resist to the sheet.

The image forming part 5 includes a scanner unit 13, a process cartridge 14, and a fixing part 15.

The scanner unit 13 is provided at the upper side inside the main body casing 2, and includes a laser emitting part (not shown), a polygon mirror 16 to be driven to rotate, lenses 17 and 18, and reflecting mirrors 19, 20, and 21.

A laser beam based on image data emitted from the laser emitting part is, as shown by the chain line, transmitted through or reflected on the polygon mirror 16, the lens 17, the reflecting mirrors 19 and 20, the lens 18, and the reflecting mirror 21 in order, and irradiated onto the surface of the photoconductor drum 24 described later of the process cartridge 14 by means of high speed scanning.

Figure 2:
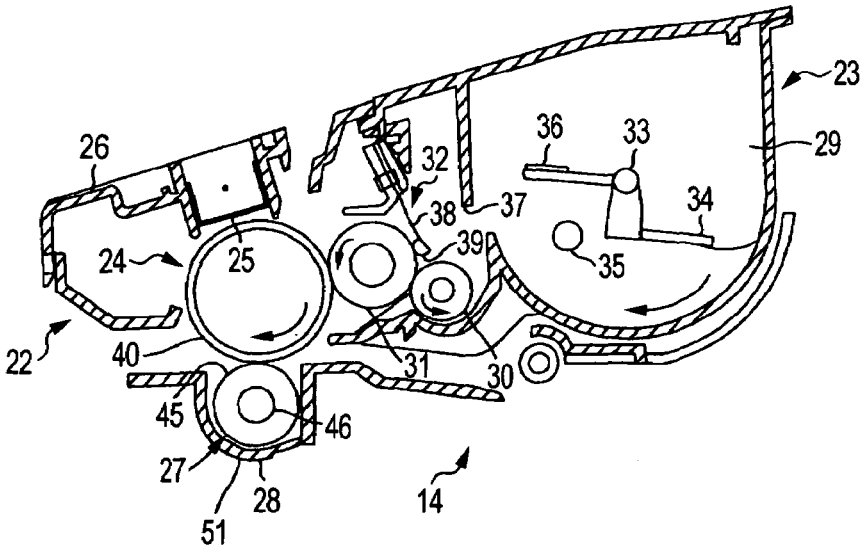
FIG. 2 is a main part side sectional view showing the process cartridge of the laser printer shown in FIG. 1.

The process cartridge 14 is provided below the scanner unit 13 and includes, as shown in FIG. 2, a drum cartridge 22 to be detachably attached to the main body casing 2 and a developing cartridge 23 to be detachably attached to the drum cartridge 22.

The drum cartridge 22 includes an upper cover member 26 in which the photoconductor drum 24 and a scorotron type charger 25 are provided and a lower cover member 28 as a cover member in which transfer roller 27 is provided.

The developing cartridge 23 includes a toner housing chamber 29, a supply roller 30, a developing roller 31 as a developer carrier, and a layer thickness limiting blade 32.

In the toner housing chamber 29, a toner made of a positively charged non-magnetic one component is housed. For this toner, a polymer toner obtained by copolymerizing polymeric monomers such as a styrene-based monomer such as styrene and an acryl-based monomer such as acrylic acid, alkyl (C1-C4) acrylate, alkyl (C1-C4) methacrylate, etc., by means of suspension polymerization is used. Such a polymer toner has a spherical form and excellent fluidity, and can form an image with high quality. Such a toner is blended with a coloring agent such as carbon black and wax, and for improvement in fluidity, added with an external additive such as silica. The average particle diameter of the toner is in a range approximately from 6 mm to 10 mm.

Furthermore, at the center of the toner housing chamber 29, a rotation shaft 33 is provided along the axial direction of the developing roller 31. On this rotation shaft 33, an agitator 34 for agitating the toner inside the toner housing chamber 29 and a cleaner 36 for cleaning windows 35 that are disposed opposite each other on both sides in the width direction (same as the axial direction of the developing roller 31) of the toner housing chamber 29 for detection of the remaining amount of toner.

Then, the toner inside the toner housing chamber 29 is agitated by the agitator 34 supported by the rotation shaft 33 when the rotation shaft 33 rotates in the direction of the arrow (clockwise), and then discharged toward the supply roller 30 from a toner discharge opening 37 of the toner housing chamber 29. By this rotation of the rotation shaft 33, the windows 35 are cleaned by the cleaner 36.

The supply roller 30 is provided so as to be rotatable in the arrow direction (counterclockwise) at the diagonally lower side of the toner discharge opening 37. In this supply roller 30, a roller member made of a conductive sponge is covered on a metal roller shaft, and both ends of the roller shaft are supported onto the developing cartridge 23 in a rotatable manner.

The developing roller 31 is disposed at the diagonally upper side opposite the supply roller 30 so as to be rotatable in the arrow direction (counterclockwise). This developing roller 31 is formed by covering a roller member made of a conductive elastic rubber on a metal roller shaft. In greater detail, the roller member of the developing roller 31 is formed by coating a coating layer made of urethane rubber or silicone rubber containing fluorine on the surface of a roller layer made of conductive urethane rubber or silicone rubber containing carbon fine particles. Furthermore, this developing roller 31 is supported on both ends of the roller shaft to the developing cartridge 23 in a rotatable manner.

In addition, a developing bias is applied to the developing roller 31 at the time of development.

Furthermore, these supply roller 30 and developing roller 31 are made to contact to each other while they are compressed to some degree.

The layer thickness limiting blade 32 has a leaf spring member 38 and a pressure contact part 39. The leaf spring member 38 is supported on one end to the developing cartridge 23 above the developing roller 31, and is provided with a pressure contact part 39 on the other end. The pressure contact part 39 is formed so as to have a roughly semicircular sectional shape and made of an insulative silicone rubber. The pressure contact part 39 presses the surface of the developing roller 31 from the side by the elastic force of the leaf spring member 38.

Then, the toner discharged from the toner discharging opening 37 is supplied to the developing roller 31 in response to the rotation of the supply roller 30, and at this point, frictionally positively electrified between the supply roller 30 and the developing roller 31, and furthermore, the toner supplied onto the developing roller 31 enters between the pressure contact part 39 and the developing roller 31 according to the rotation of the developing roller 31 and carried onto the developing roller 31 as a thin layer.

The photoconductor drum 24 is disposed at the side of the developing roller 31 so as to be opposite the developing roller 31 and rotatable in the arrow direction (clockwise) with respect to the drum cartridge 22. This photoconductor drum 24 includes, as shown in FIG. 3, a drum main body 40 as an image carrier and a drum gear 41 that is provided on one end in the axial direction of the drum main body 40 as a second driving member for driving the drum main body 40.

The drum main body 40 has a cylindrical shape, and its length in the axial direction is formed to be longer than the length in the axial direction of the roller member 45 described later of the transfer roller 27, and disposed along the axial direction of the roller member 45 above the roller member 45 so that both ends (both end faces) in the axial direction of the drum main body 40 are not opposite both ends (both end faces) in the axial direction of the roller member 45, that is, in a positional relationship where the central portion in the axial direction of the roller member 45 and the central portion in the longitudinal direction of the drum main body 40 roughly coincide with each other, and shaft-borne on the upper cover member 26 in a rotatable manner. Furthermore, the drum main body 40 is grounded, and its surface is formed by a positively charged layer made of polycarbonate, etc.

The drum gear 41 is provided so as not to rotate relatively to the drum main body 40 on one end of the drum main body 40, and integrally includes a drum gear part 42 on the outer side in the axial direction, and a drum flange gear part 43 having the same diameter as that of the drum gear part 42 on the inner side in the axial direction.

Figure 3:
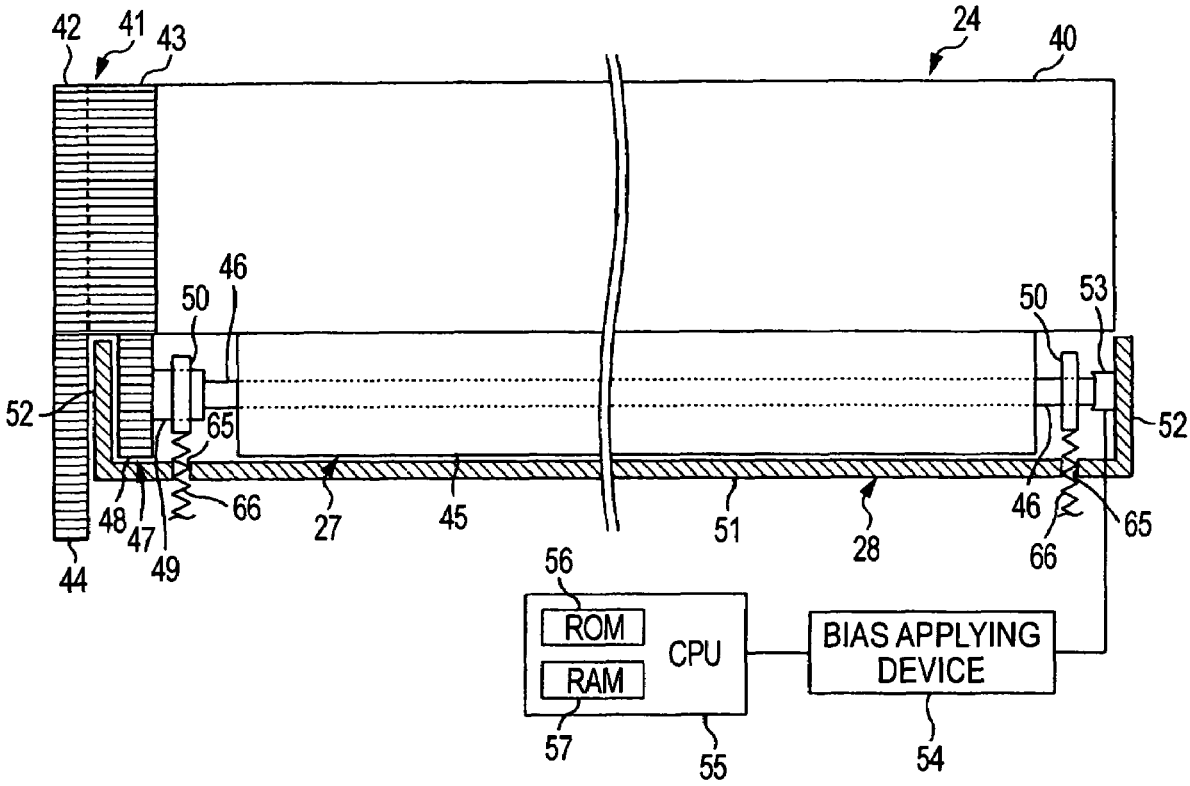
FIG. 3 is a main part front sectional view showing the drum cartridge of the process cartridge shown in FIG. 2.
Figure 4:
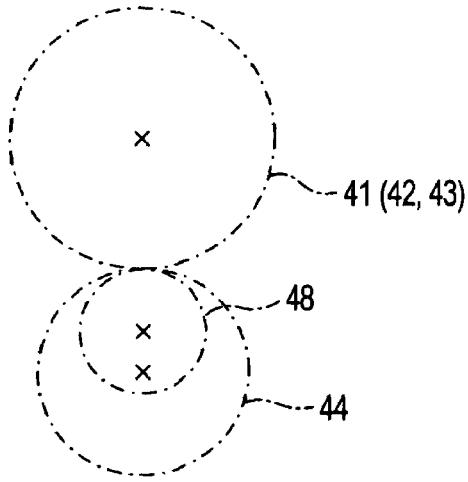
FIG. 4 is an arrangement view showing arrangement of gears (in a manner that the projection surface of the transfer roller gear is disposed within the projection surface of the input gear in the axial direction of the roller shaft) in the process cartridge shown in FIG. 2.

The drum gear part 42 is disposed so that, while the process cartridge 14 is attached inside the main body casing 2, as shown in FIG. 3, an input gear 44 as a power input member provided inside the main body casing 2 and the drum gear part 42 are disposed at the upper and lower sides, respectively, adjacent to each other, and as shown in FIG. 4, they are engaged while the rotation center of the drum gear part 42 and the rotation center of the input gear 44 are disposed on the same vertical line. Into the input gear 44, power is inputted from a motor that is provided inside the main body casing 2 although it is not shown, and the input gear 44 inputs the power into the drum gear part 42.

The scorotron type charger 25 is provided above the photoconductor drum 24 by leaving a predetermined space so as not to come into contact with the drum main body 40 as shown in FIG. 2. This scorotron type charger 25 is a positive-charging scorotron type charger for generating corona discharge from a charging wire of tungsten, etc., and evenly positively charges the surface of the drum main body 40.

When power is inputted from the input gear 44 into the drum gear part 42, the drum main body 40 is rotated, and the surface of the drum main body 40 is evenly positively charged by the scorotron type charger 25 in response to the rotation of the drum main body 40, and then exposed by means of laser beam high speed scanning from the scanner unit 16, and then an electrostatic latent image based on image data is formed.

Then, when the toner carried on the developing roller 31 and positively charged comes into opposite contact with the drum main body 40 in response to the rotation of the developing roller 31, the toner is supplied to the portion of the electrostatic latent image formed on the surface of the drum main body 40, that is, in the surface of the drum main body 40 evenly positively charged, the exposed portion that has been exposed to a laser beam and lowered in potential, and the toner is selectively carried, whereby the image is made visible, and accordingly, inversion development is realized and a toner image is carried on the surface of the drum main body 40.

The transfer roller 27 is disposed opposite the photoconductor drum 27 below the photoconductor drum 27, and is supported by the drum cartridge 22 so as to be rotatable in the arrow direction (counterclockwise).

This transfer roller 27 includes, as shown in FIG. 3, a cylindrical roller member 45 as a transfer member made of a conductive elastic rubber, and a roller shaft 46 as a metal shaft member that is inserted into the roller member 45 so as not to relatively rotate and supports the roller member 45.

The roller member 45 is formed so that the length in the axial direction thereof is shorter than the length in the axial direction of the drum main body 40, and is disposed in contact with the drum main body 40 along the axial direction of the drum main body 40 below the drum main body 40.

Figure 5:
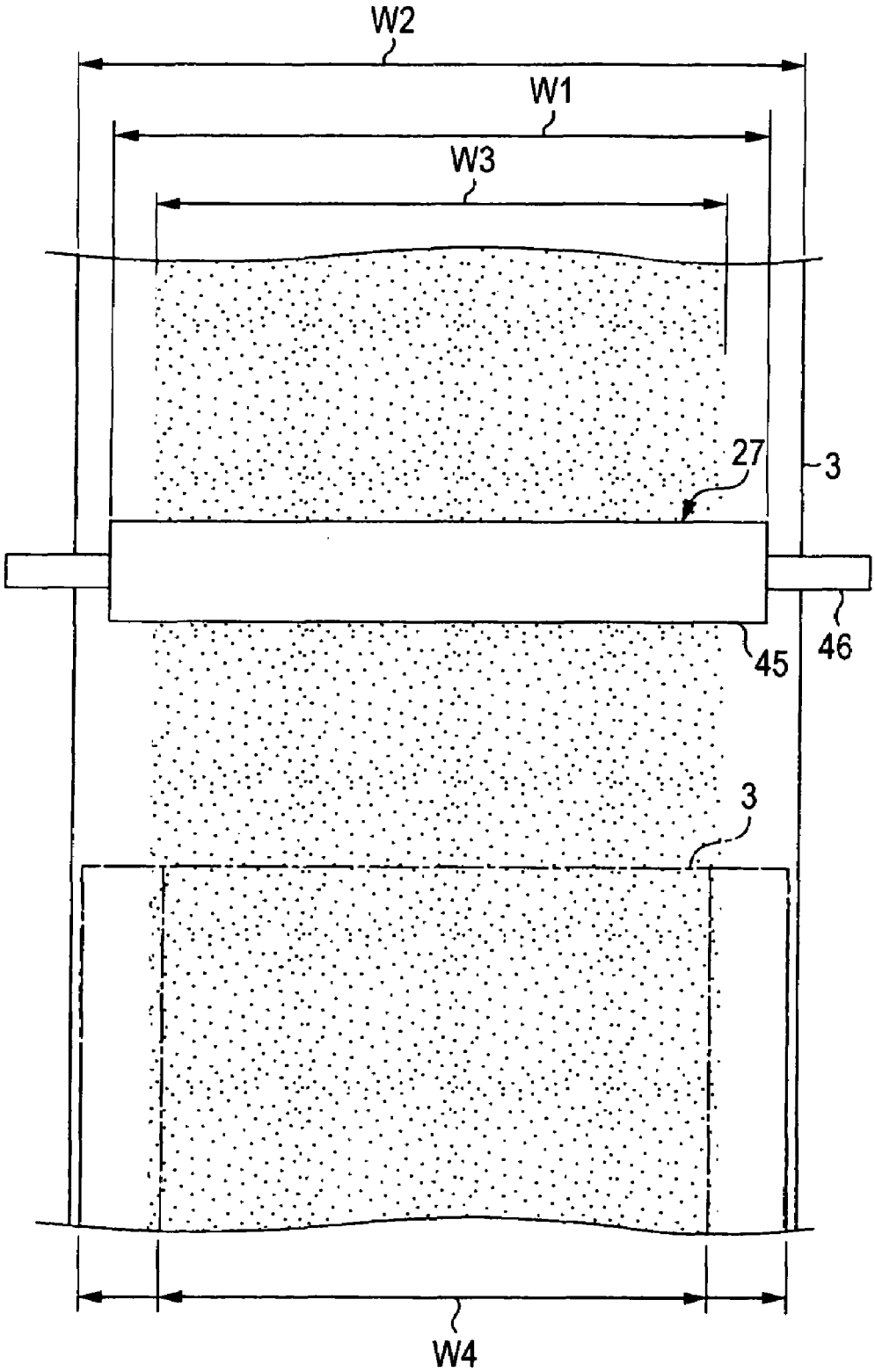
FIG. 5 is a plan view describing the length in the axial direction of the transfer roller in the process cartridge shown in FIG. 2.

In greater detail, the roller member 45 is formed so that, as shown in FIG. 5, the length in the axial direction of the roller member 45 (transfer effective width W1) is shorter than the width of the sheet 3 with a maximum width (maximum sheet width W2) on which an image can be formed with this laser printer 1, and longer than the width capable of being formed with an image (maximum image forming width W3) in this laser printer 1. More concretely, for example, when the maximum sheet width W2 is 216 mm (letter size) and the maximum image forming width W3 is approximately 208 mm, the transfer effective width W1 is set to 210 through 215 mm.

On one end in the axial direction of the roller shaft 46, a transfer roller gear part 47 opposite the drum gear 41 in the vertical direction is provided so as not to rotate relatively to the roller shaft 46.

This transfer roller gear part 47 is made of a resin, and integrally includes a transfer roller gear 48 as a first driving member for driving the roller member 45 and a sliding cylinder part 49 as a sliding member to be slidably received by a bearing member 50 that is described next.

The transfer roller gear 48 is disposed at the outer side in the axial direction on one end of the roller shaft 46, and the sliding cylinder part 49 is disposed at the inner side in the axial direction on one end of the roller shaft 46.

As shown in FIG. 3, the transfer roller gear 48 is formed to have a diameter smaller than that of the input gear 44 and is disposed adjacent to a drum flange gear part 43 so that the drum flange gear part 43 comes upward and the transfer roller gear 48 comes lower, and as shown in FIG. 4, the drum flange gear part 43 and the transfer roller gear 48 are engaged with each other while their rotation centers are disposed on the same vertical line.

In addition, the transfer roller gear 48 is disposed as shown in FIG. 3 so that the input gear 44 comes outward and the transfer roller gear 48 comes inward in the axial direction of the roller shaft 46 while overlapping each other. In greater detail, as shown in FIG. 4, in the axial direction of the roller shaft 46, they are disposed so that the projection surface of the transfer roller gear 48 is disposed within the projection surface of the input gear 44, and the portion of the transfer roller gear 48 engaged with the drum flange gear part 43 projects and overlaps in the axial direction the portion of the input gear 44 engaged with the drum gear part 42, and the transfer roller gear 48 comes into inner contact with the input gear 44.

As shown in FIG. 3, the sliding cylinder part 49 has a cylindrical shape, and is formed so as to be smaller in diameter than the transfer roller gear 48, and is slidably received by the bearing member 50 disposed inside the lower cover member 28.

Namely, the lower cover member 28 is made of a resin and has, as shown in FIG. 2, a rough C shape integrally including a lower plate 51 covering the lower side of the transfer roller 27 in the circumferential direction and, as shown in FIG. 3, side plates 52 bent upward from the lower plate 51 at both outer sides in the axial direction of the roller shaft 46, and inside the lower plate 51, the bearing members 50 are disposed. One side plate 52 is disposed between the input gear 44 and the transfer roller gear part 47, and the other side plate 52 is disposed at the side outer than the other end in the axial direction of the roller shaft 46. Furthermore, on the other side plate 52, an electrode 53 is provided which is disposed axially opposite the other end in the axial direction of the roller shaft 46 and is in contact with the other end in the axial direction of the roller shaft 46 in a slidable manner.

Furthermore, in the lower plate 51, openings 65 are formed at positions opposite the respective bearing members, and in the openings 65, pressing springs 66 one end portions of which are fixed to the main body casing 2 are inserted vertically.

The bearing members 50 are made of a resin, and between the drum main body 40 and the lower plate 51, that is, below the drum main body 40, the bearing members 50 are provided opposite each other at both ends in the axial direction of the drum main body 40 which are not opposite both ends in the axial direction of the roller member 45. Thereby, the roller member 45 is pressed toward the drum main body 40 by the pressing forces of the pressing springs 66. One bearing member 50 shaft-bears the sliding cylinder part 49 in a rotatable manner and supports the sliding cylinder part 49. The other bearing member 50 shaft-bears the roller shaft 46 in a rotatable manner and supports the roller shaft 46.

To the electrode 53 that comes into contact with the other end in the axial direction of the roller shaft 46, a bias applying device 54 as a bias applying unit for applying a transfer bias is connected.

This bias applying device 54 is provided inside the main body casing 2, and can perform constant current control and constant voltage control in processing of a transfer bias control program described later. Thus, by making it possible to perform constant current control and constant voltage control, as described later, a proper transfer bias can be applied by selecting the constant current control or the constant voltage control depending on whether or not the sheet width (transfer sheet width W4, see FIG. 5) of the sheet 3 for transferring is equal to or longer than the length in the axial direction of the roller member 45 (transfer effective width W1, see FIG. 5).

Furthermore, the bias applying device 54 is connected to a CPU 55 as a bias control unit provided inside the main body casing 2.

The CPU 55 controls the respective parts including the bias applying device 54, and includes a ROM 56 and a RAM 57. In the ROM 56, various programs, for example, a transfer bias control program for controlling a transfer bias described later and a transfer bias table described later are stored. In the RAM 57, temporary values for executing various programs are stored.

At the time of transfer, when power is inputted into the input gear 44 from a motor that is not shown, the power is inputted into the drum gear part 42 that engages with the input gear 44, whereby the drum main body 40 is rotated. In addition, since the drum flange gear part 43 is rotated integrally with the drum gear part 42, the power is inputted into the transfer roller gear 48 that engages with the drum flange gear part 43. Thereby, the roller member 45 is rotated together with the roller shaft 46.

Furthermore, at the time of transfer, the transfer bias control program in the ROM 56 is started by the CPU 55 to control the bias applying device 54, whereby a transfer bias is applied to the roller shaft 46 via the electrode 53 from the bias applying device 54. The transfer bias is applied to the roller member 45 from the roller shaft 46 for transferring the toner image carried on the surface of the drum main body 40 onto the sheet 3.

Then, when the sheet 3 is conveyed from the resist roller 11 to a position (transfer position) between the drum main body 40 and the roller member 45, by the rotation of the drum main body 40 and the roller member 45, while the sheet 3 is conveyed between these, the toner image carried on the surface of the drum main body 40 is transferred onto the sheet by the transfer bias applied to the roller member 45.

The fixing part 15 is provided at the downstream side of the direction of conveyance of the sheet 3 at the side of the process cartridge 14. The fixing part 15 includes a heating roller 58, a pressurizing roller 59, and a pair of conveying rollers 60.

The heating roller 58 includes a metal roller part and a halogen lamp for heating inside the roller part. The pressurizing roller 59 is disposed opposite the heating roller 58 so as to press the heating roller 58 below the heating roller 58. The pair of conveying rollers 60 are disposed at the downstream sides of the direction of conveyance of the sheet 3 of the heating roller 58 and the pressurizing roller 59.

At this fixing part 15, the toner transferred onto the sheet 3 at the transfer position is heat-fixed while the sheet 3 passes between the heating roller 58 and the pressurizing roller 59, and thereafter, the sheet 3 is conveyed to an eject path 61 by the pair of conveying rollers 60.

On the upper surface of the main body casing 2, a sheet output tray 62 for receiving the sheet 3 in a manner enabling the sheets to stack. Above the side of the sheet output tray 62 opposite the fixing part 15, an eject roller 63 is provided. Between the eject roller 63 and the conveying roller 60 of the fixing part 15, a conveying path 61 for conveying the sheet 3 is provided.

Then, the sheet 3 conveyed to the eject path 61 from the fixing part 15 is conveyed to the eject roller 63 from the eject path 61, and ejected onto the sheet output tray 62 by the eject roller 63.

In addition, in this laser printer 1, the toner remaining on the surface of the drum main body 40 after transferring onto the sheet 3 by the roller member 45 is collected by the developing roller 31, that is, the remaining toner is collected according to a so-called cleaner-less method. By collecting the remaining toner on the surface of the drum main body 40 by such a cleaner-less method, it becomes unnecessary to provide a cleaner unit such as a blade or waste toner reservoir means, so that the apparatus can be simplified, downsized, and reduced in cost.

In the laser printer 1, at the time of transfer, the transfer bias control program is started, and depending on whether or not the sheet width of the transfer sheet 3 (that is, the transfer sheet width W4) is equal to or longer than the length in the axial direction of the roller member 45 (that is, the transfer effective width W1), and when the sheet width is equal or longer, a transfer bias is applied by means of constant current control of the first control method, and when the sheet width is shorter, a transfer bias is applied by means of constant voltage control of the second control method.

Next, processing of such transfer bias control program is described with reference to the flowchart shown in FIG. 6.

Figure 6:
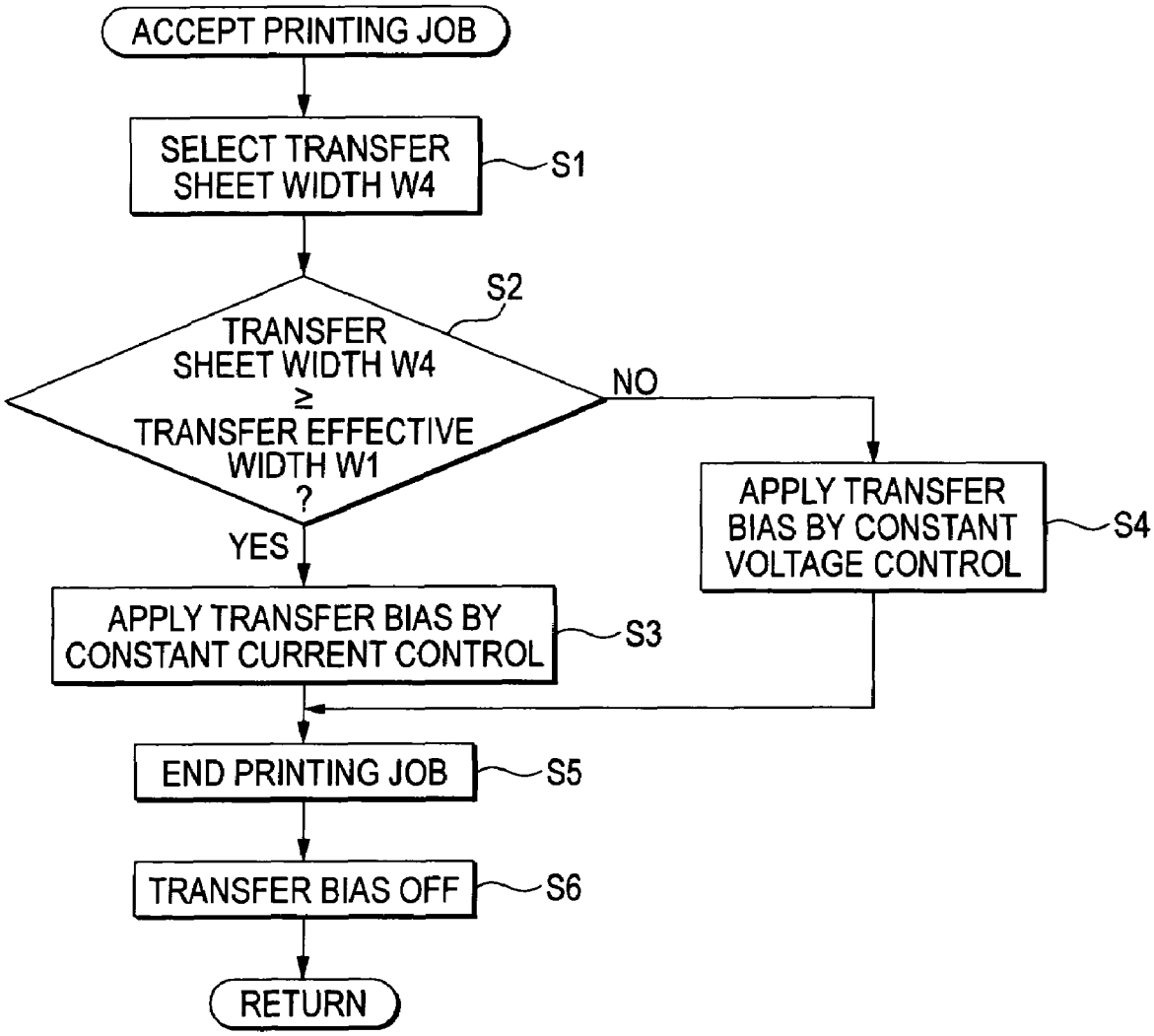
FIG. 6 is a flowchart showing processing of the transfer bias control program (in a manner of switching constant current control and constant voltage control)

In FIG. 6, this processing is started when the CPU 55 accepts a printing job. When the processing is started, first, a transfer sheet width W4 is selected (S1). The transfer sheet width W4 is selected by setting a transfer sheet width W4 of the sheet 3 to be used for transferring by detecting the sheet size by a sheet size detection sensor that is provided inside the paper feed tray 6 and is not shown.

Next, it is determined whether or not the transfer sheet width W4 is equal to or longer than the transfer effective width W1 (S2). When the transfer sheet width W4 is equal to or longer than the transfer effective width W1 (S2: YES), the CPU 55 controls the bias applying device 54 to apply a transfer bias in constant current control (S3). On the other hand, when the transfer sheet width W4 is not equal to or longer than the transfer effective width W1, that is, when the transfer sheet width W4 is shorter than the transfer effective width W1 (S1: NO), the CPU 55 controls the bias applying device 54 to apply a transfer bias in constant voltage control (S4).

An example of a transfer bias table to be applied in the processing described above is shown in Table 1.

TABLE 1

| Sheet size | Letter | A4 | B5 | A5 | B6 | A6 |
|---|---|---|---|---|---|---|
| Sheet width (mm) | 216 | 210 | 182 | 148 | 128 | 105 |

TABLE 1-continued

| Control method | Constant current control | Constant voltage control |
|---|---|---|
| | −14 μA | −3.5 μA |

As shown in Table 1, in this processing, when the transfer sheet width W4 is equal to or longer than the transfer effective width W1, that is, for example, when the sheet 3 is in letter size, constant current control is performed in which a transfer bias is applied at a constant transfer current of −14 μA. On the other hand, when the transfer sheet width W4 is shorter than the transfer effective width W1, constant voltage control is performed in which a transfer bias is applied at a constant transfer voltage of −3.5 kV.

Thereafter, when the image forming corresponding to the accepted printing job is finished (S5), the CPU 55 controls the bias applying device 54 and the transfer bias is turned OFF (S6), and by returning, the transfer bias control program is ended.

In such a control, in the laser printer 1, the transfer effective width W1 of the roller member 45 of the transfer roller 27 is formed to be shorter than the maximum sheet width W2, so that when the transfer sheet 3 is a sheet 3 with the maximum sheet width W2 (with, for example, letter size), the roller member 45 comes into contact with the entire sheet 3 in the axial direction. On the other hand, when the transfer sheet 3 is a sheet 3 (with, for example, A4 size or smaller) the width of which is shorter than the width of the sheet 3 with the maximum sheet width W2, a region of the roller member where the roller member 45 does not come into contact with the sheet 3 in the axial direction, that is, the region where the drum main body 40 is in direct contact with the roller member 45 is reduced more than in the case where the transfer effective width W1 is formed to be longer than the maximum sheet width W2.

Therefore, when the transfer sheet width W4 of the sheet 3 to be used for transferring is equal to or longer than the transfer effective width W1 of the roller member 45, the transfer bias does not leak, and when the transfer sheet width is shorter than the transfer effective width W1 of the roller member 45, leak of the transfer bias can be reduced more than in the case where the transfer effective width W1 of the roller member 45 is formed longer than the maximum sheet width W2. Therefore, a toner image can be transferred with a low transfer current onto the sheet 3 with a narrow sheet width.

In this control, depending on whether or not the transfer sheet width W4 of the sheet 3 to be used for transferring is equal to or longer than the transfer effective width W1 of the roller member 45, the constant current control or the constant voltage control is selected and a transfer bias is applied, so that a proper transfer bias is applied according to the ease of occurrence of transfer bias leak. Therefore, the drum main body 40 can be prevented from being damaged by excessive application of a transfer current while preventing a transfer failure caused by shortage in application of the transfer current.

In greater detail, in this control, when the transfer sheet width W4 of the sheet 3 to be used for transferring is equal to or longer than the transfer effective width W1 of the roller member 45, a transfer bias is applied by constant current control, and when it is shorter than the transfer effective width W1, transfer bias is applied by constant voltage control. Therefore, by simple control of switching the control method, a necessary and sufficient transfer current can be applied to the sheet 3 without fail by constant current control when the transfer sheet width W4 of the sheet 3 to be used for transferring is equal to or longer than the transfer effective width W1 of the roller member 45, and when it is shorter than the transfer effective width, leak of a transfer current can be compensated by constant voltage control and a necessary and sufficient transfer current can be applied to the sheet 3 without fail.

Furthermore, in the abovementioned control, depending on whether or not the transfer sheet width W4 of the sheet 3 to be used for transferring is equal to or longer than the transfer effective width W1 of the roller member 45, when it is equal to or longer, a transfer bias is applied by constant current control, and when it is shorter than the transfer effective width, a transfer bias is applied by constant voltage control, however, it is also possible that, for example, when the transfer sheet width is equal to or longer than the transfer effective width W1, a transfer bias is applied by constant current control using a constant transfer current regardless of the transfer sheet width W4 of the sheet 3 as a first control method, and when the transfer sheet width is shorter, as a second control method, a transfer bias is applied with a transfer current higher than that in the constant current control when the transfer sheet width is equal or longer by constant current control in which the transfer current is changed according to the transfer sheet width W4 of the sheet 3.

Figure 7:
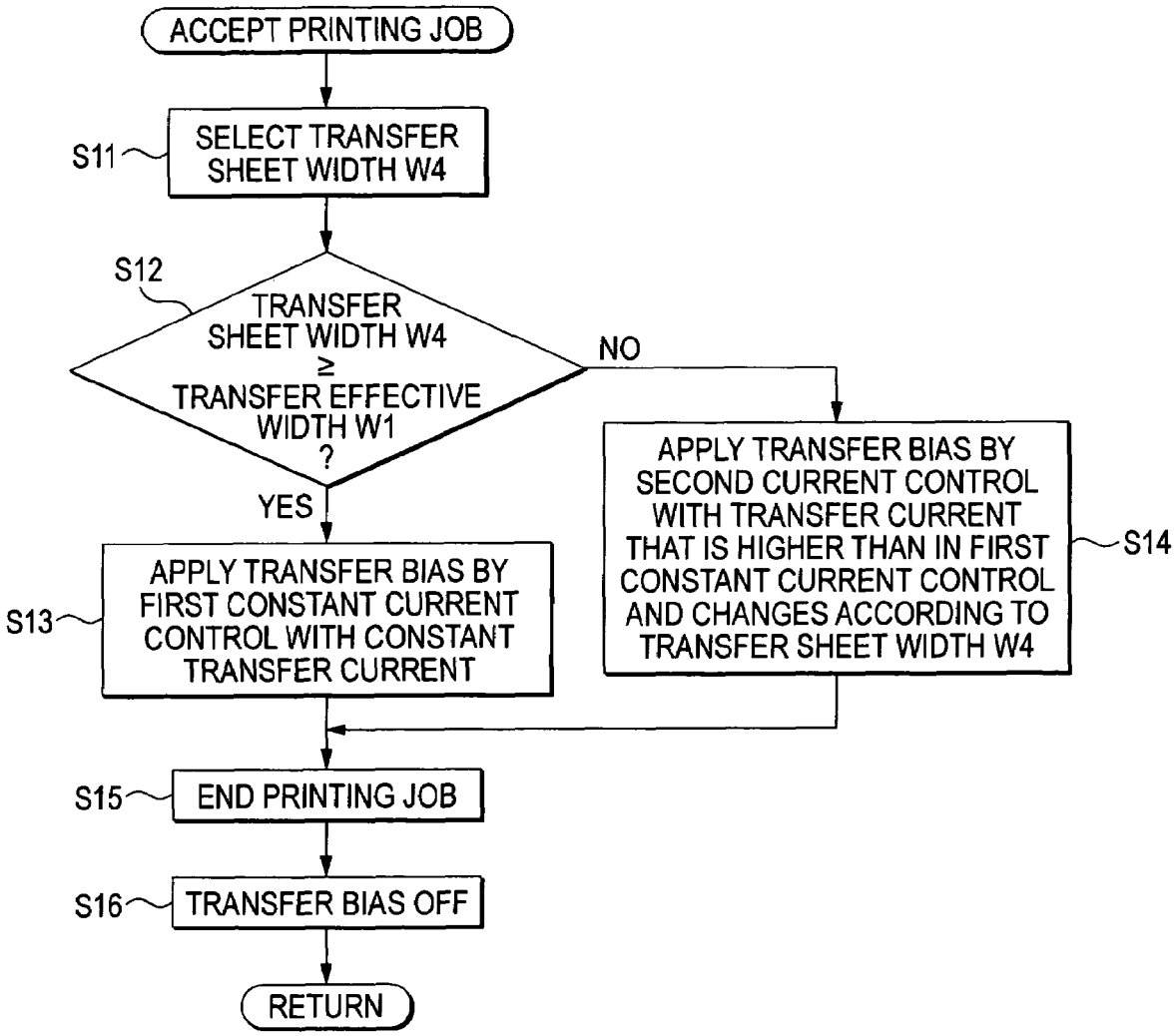
FIG. 7 is a flowchart showing processing of the transfer bias control program (in a manner of switching the first constant current control and the second constant current control)

FIG. 7 is a flowchart showing this transfer bias control program processing.

As shown in FIG. 7, this processing is started when the CPU 55 accepts a printing job as in the case described above. When the processing is started, first, as in the case described above, the transfer sheet width W4 is selected (S11).

Next, it is determined whether or not the transfer sheet width W4 is equal to or longer than the transfer effective width W1 (S12). Then the transfer sheet width W4 is equal to or longer than the transfer effective width W1 (S12: YES), the CPU 55 controls the bias applying device 54 to applies a transfer bias by the first constant current control using a constant transfer current (S13). On the other hand, when the transfer sheet width W4 is not equal to or longer than the transfer effective width W1, that is, when the transfer sheet width W4 is shorter than the transfer effective width W1 (S12: NO), the CPU 55 controls the bias applying device 54 and apply a transfer bias by the second constant current control using a transfer current that is higher than that of the first constant current control and changes according to the transfer sheet width W4 (S14).

Table 2 shows an example of a table of transfer biases to be applied in such processing.

TABLE 2

| Sheet size | Letter | A4 | B5 | A5 | B6 | A6 |
|---|---|---|---|---|---|---|
| Sheet width (mm) | 216 | 210 | 182 | 148 | 128 | 105 |
| Control method | Constant current control | | | | | |
| | −14 μA | −16 μA | −18 μA | −20 μA | −24 μA | −28 μA |

As shown in Table 2, in this processing, when the transfer sheet width W4 is equal to or longer than the transfer effective width W1, that is, for example, when the sheet 3 is in letter size, regardless of the transfer sheet width W4 of the sheet 3, the first constant current control is performed in which a transfer bias is applied with a constant transfer current of −14 μA. On the other hand, when the transfer sheet width W4 is shorter than the transfer effective width W1, the second constant voltage control is performed in which a transfer bias is applied with a transfer current of, for example, −16 μA when the sheet is in a size A4, −18 μA when the sheet 3 is a size B5, −20 μA when the sheet is in a size A5, −24 μA when the sheet is in a size B6, and −28 μA when the sheet is in a size A6, which is a transfer current higher than the transfer current (−14 μA) of the first current control corresponding to the transfer sheet width W4 of the sheet 3.

Thereafter, when image forming corresponding to the accepted printing job is finished (S15), the CPU 55 controls the bias applying device 54 to turn the transfer bias off (S16), and by returning, the transfer bias control program is ended.

In such a control, when the transfer sheet width W4 of the sheet 3 to be used for transferring is equal to or longer than the transfer effective width W1 of the roller member 45, a transfer bias is applied with a constant transfer current by the first constant current control. When the transfer sheet width is shorter than the transfer effective width W1 of the roller member 45, a transfer bias is applied while the transfer current changes according to the transfer sheet width W4 of the sheet 3 by the second constant current control. Therefore, depending on whether or not the transfer sheet width W4 of the sheet 3 to be used for transferring is equal to or longer than the transfer effective width W1 of the roller member 45, furthermore, when it is shorter than the transfer effective width W1 of the roller member 45, a transfer bias can be applied with a proper transfer current corresponding to the transfer sheet width W4 of the sheet 3 to be used for transferring by the constant current control.

Furthermore, it is also possible that, by simplifying the abovementioned control, depending on whether or not the transfer sheet width W4 of the sheet 3 to be used for transferring is equal to or longer than the transfer effective width W1 of the roller member 45, when it is equal to or longer, as the first control method, regardless of the transfer sheet width W4 of the sheet 3, a transfer bias is applied by constant current control using a constant transfer current, and when the transfer sheet width is shorter, as the second control method, a transfer bias is applied by constant current control using a constant transfer current higher than that in the constant current control when the transfer sheet width is equal to or longer, regardless of the transfer sheet width W4 of the sheet 3.

Such processing of the transfer bias control program is realized by applying a transfer bias by the second constant current control using a transfer current that is higher than that of the first constant current control and is constant by controlling the bias applying device 54 by the CPU 55 in Step S14 in FIG. 7.

In Table 3, an example of a table of transfer biases to be applied in this processing is shown.

TABLE 3

| Sheet size | Letter | A4 | B5 | A5 | B6 | A6 |
|---|---|---|---|---|---|---|
| Sheet width (mm) | 216 | 210 | 182 | 148 | 128 | 105 |
| Control method | Constant current control | | | | | |
| | −14 μA | −20 μA | | | | |

As shown in table 3, in this processing, when the transfer sheet width W4 is equal to or longer than the transfer effective width W1, that is, for example, the sheet 3 is in letter size, regardless of the transfer sheet width W4 of the sheet 3, the first constant current control is performed in which a transfer bias is applied with a constant transfer current of −14 μA. On the other hand, when the transfer sheet width W4 is shorter than the transfer effective width W1, regardless of the transfer sheet width W4 of the sheet 3, the second constant current control is performed in which a transfer bias is applied with a constant transfer current of −20 μA that is higher than the transfer current (−14 μA) of the first constant current control.

In such a control, when the transfer sheet width W4 of the sheet 3 to be used for transferring is equal to or longer than the transfer effective width W1 of the roller member 45, a transfer bias is applied with a transfer current that is always constant by the first constant current control. On the other hand, when the transfer sheet width is shorter than the transfer effective width W1 of the roller member 45, by the second constant current control, a transfer bias that is always constant and higher than the transfer current (−14 μA) of the first constant current control is applied. Therefore, a proper transfer bias can be applied by simple control in which the transfer current is selectively switched by constant current control depending on whether or not the transfer sheet width W4 of the sheet 3 to be used for transferring is equal to or longer than the transfer effective width W1 of the roller member 45.

In addition, in the laser printer 1, the roller member 45 of the transfer roller 27 is formed to be shorter than the maximum sheet width W2, whereby the roller member 45 of the transfer roller 27 is sufficiently shorter than the length in the axial direction of the drum main body 40 in comparison with the conventional case. Therefore, as shown in FIG. 3, by disposing the drum main body 40 along the axial direction of the roller member 45 so that both ends in the axial direction of the roller member 45 are not opposite both ends in the axial direction of the roller member 45, below the drum main body 40, the bearing members 50 provided at both ends in the axial direction of the roller member 45 can be disposed so as to be opposite each other at both ends in the axial direction of the drum main body 40 that are not opposite both ends in the axial direction of the roller member 45. Therefore, the length in the axial direction of the roller shaft 46 supporting the roller member 45 can be made shorter, whereby the apparatus can be reduced in size and weight.

Figure 8:
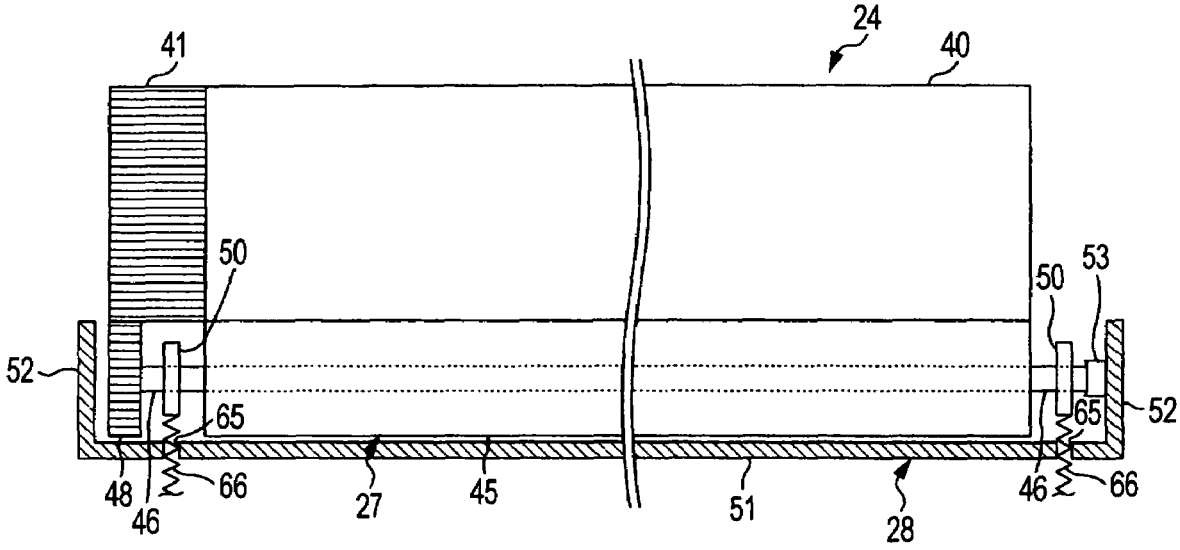
FIG. 8 is a main part front sectional view showing the drum cartridge of the process cartridge (in a manner that the drum main body and the roller member are almost equal to each other in length in their axial directions)

Namely, for example, as shown in FIG. 8, when the drum main body 40 of the photoconductor drum 24 and the roller member 45 of the transfer roller 27 are formed so as to have almost the same length in their axial directions, by providing the bearing members 50 for shaft-bearing the roller shaft 46 of the transfer roller 27 are provided at the outer sides of both ends of the roller member 45, the bearing members 50 are disposed at sides outer than both ends in the axial direction of the drum main body 40, and the length in the axial direction of the roller shaft 46 needs to be lengthened accordingly.

However, by forming the roller member 45 of the transfer roller 27 sufficiently shorter than the length in the axial direction of the drum main body 40 as described above, as shown in FIG. 3, below the drum main body 40, the bearing members 50 can be disposed so as to be opposite each other at both ends in the axial direction of the drum main body 40 that are not opposite both ends in the axial direction of the roller member 45, and the length in the axial direction of the roller shaft 46 supporting the roller member 45 can be shortened, whereby the apparatus can be downsized.

In addition, in the transfer roller 27, on the transfer roller gear part 47 provided on one end in the axial direction of the roller shaft 46, the transfer roller gear 48 is integrally provided with a sliding cylinder part 49 to be shaft-borne by the bearing member 50. Therefore, while the length in the axial direction of the roller shaft 46 is shortened without fail, the sliding cylinder part 49 is simply formed integrally with the transfer roller gear 48, whereby the assembling work can be made more efficient.

Namely, as referring to FIG. 8, for example, on one end in the axial direction of the roller shaft 46 where the transfer roller gear 48 is provided, between the roller member 45 and the transfer roller gear 48, a portion to be shaft-borne by the bearing member 50 becomes necessary, and clearances are created between the roller member 45 and the bearing portion and between the bearing portion and the transfer roller gear 48, respectively, and the length in the axial direction of the roller shaft 46 must be lengthened to an extent corresponding to the clearances.

However, as referring to FIG. 3, when the transfer roller gear 48 is integrally provided with the sliding cylinder part 49 and the sliding cylinder part 49 is shaft-borne by the bearing member 50, the length in the axial direction of the roller shaft 46 can be shortened without fail. In addition, in the transfer roller gear part 47, the assembling work can be made more efficient by simply forming the sliding cylinder part 49 integrally with the transfer roller gear 48.

Furthermore, since the sliding cylinder part 49 and the bearing members 50 are both formed from a resin, smooth sliding is obtained and durability is improved.

Furthermore, in the arrangement described above, the length in the axial direction of the drum main body 40 is sufficiently longer than the length in the axial direction of the roller member 45, one end in the axial direction where the drum gear 41 is provided in the drum main body 40 and one end in the axial direction where the transfer roller gear 48 is provided in the roller member 45 are disposed so as not to be opposite each other, whereby the input gear 44 and the transfer roller gear 48 can be disposed so as to overlap each other in the axial direction of the roller shaft 46 as shown in FIG. 4. Therefore, the apparatus can be downsized, and the degree of freedom in arrangement of the gears including the input gear 44, the drum gear 41, and the transfer roller gear 48 can be increased.

Figure 9:
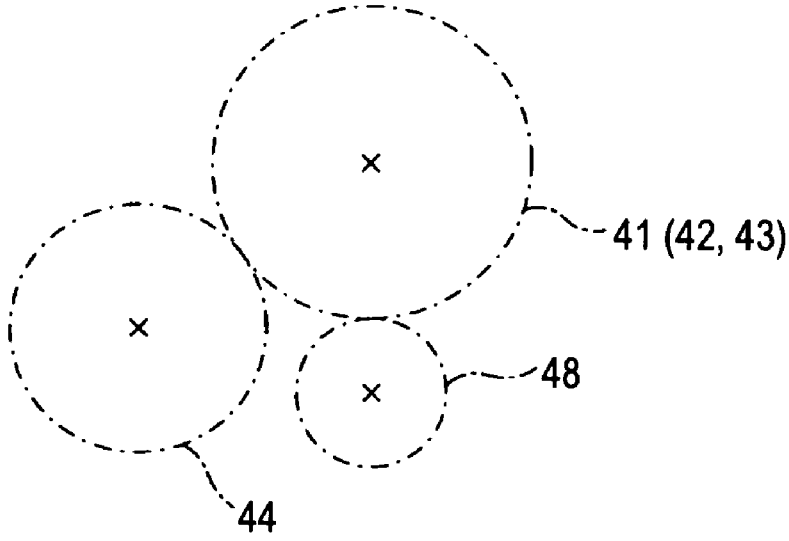
FIG. 9 is an arrangement view showing arrangement of gears in the process cartridge (in a manner that the projection surface of the transfer roller gear and the projection surface of the input gear do not overlap each other in the axial direction of the roller shaft)

Namely, as shown in FIG. 9, for example, when the length in the axial direction of the drum main body 40 is almost equal to the length in the axial direction of the roller member 45, the input gear 44 and the transfer roller gear 48 cannot overlap in the axial direction of the roller shaft 46, and therefore, the input gear 44 and the transfer roller gear 48 must be disposed not to interfere with each other, and the degree of freedom in arrangement of gears is greatly limited.

However, as shown in FIG. 3, when the length in the axial direction of the roller member 45 is formed to be sufficiently shorter than the length in the axial direction of the drum main body 40, and one end in the axial direction where the drum gear 41 is provided in the drum main body 40 and one end in the axial direction where the transfer roller gear 48 is provided in the roller member 45 can be disposed not to be opposite each other, whereby the input gear 44 and the transfer roller gear 48 can be disposed so as to overlap each other in the axial direction of the roller shaft 46 as shown in FIG. 4, and therefore, the degree of freedom in arrangement of the gears can be increased.

Particularly, in this arrangement, since the projection surface of the transfer roller gear 48 formed to be smaller than the input gear is disposed within the projection surface of the input gear 44 in the axial direction of the roller shaft 46, the apparatus can be further downsized.

Figure 10:
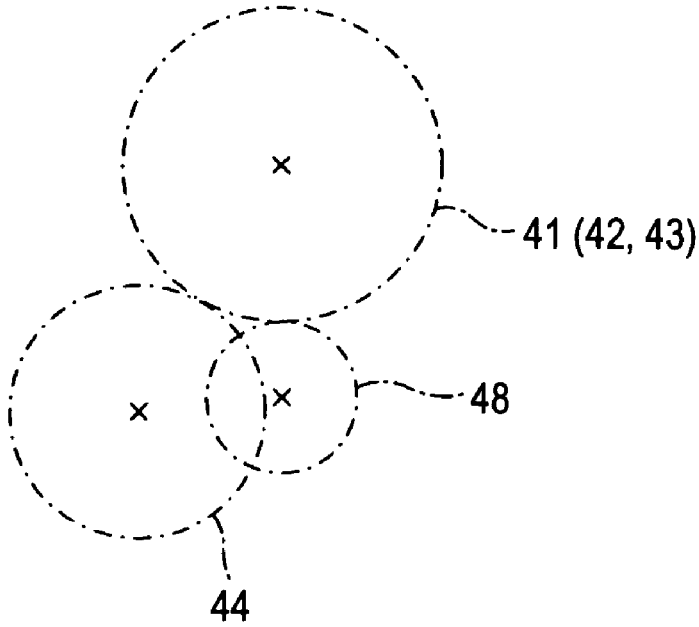
FIG. 10 is an arrangement view showing arrangement of gears in the process cartridge (in a manner that the projection surface of the transfer roller gear and the projection-surface of the input gear partially overlap each other in the axial direction of the roller shaft)

Furthermore, even when the projection surface of the transfer roller gear 48 is not disposed within the projection surface of the input gear 44 in the axial direction of the roller shaft 46 and the input gear 44 and the transfer roller gear 48 are disposed so as to partially overlap in the axial direction of the roller shaft 46 as shown in FIG. 10, downsizing of the apparatus is also realized.

In addition, on the other end of the roller shaft 45 at the opposite side in the axial direction of the roller shaft 45 of the one end where the transfer roller gear 47 is provided, the end in the axial direction of the drum main body 40 is disposed so as not to be opposite the end in the axial direction of the roller member 41. Therefore, adhesion of the toner dropping off the drum main body 40 to the other end of the roller shaft 45 where the transfer roller gear 47 is not provided can be reduced.

Namely, the toner is carried in a form of a thin film on the developing roller 31, however, on both ends in the axial direction of the developing roller 31 with which the pressure contact part 39 of the layer thickness limiting blade 32 is not in pressure contact, excessive toner that is not made into pressure contact by the pressure contact part 39 adheres to both ends in the axial direction of the drum main body 40 from both ends in the axial direction of the developing roller 31, and drops from both ends in the axial direction of the drum main body 40.

Therefore, in this case, by disposing both ends in the axial direction of the drum main body 40 so as not to be opposite both ends in the axial direction of the roller member 41, and at the other end of the roller shaft 45 where the transfer roller gear part 47 is not provided, by forming the roller shaft 46 projecting from the other end in the axial direction of the roller member 41 short (see FIG. 12), the toner dropping from the drum main body 40 can be prevented from adhering to the roller shaft 45.

Figure 11:
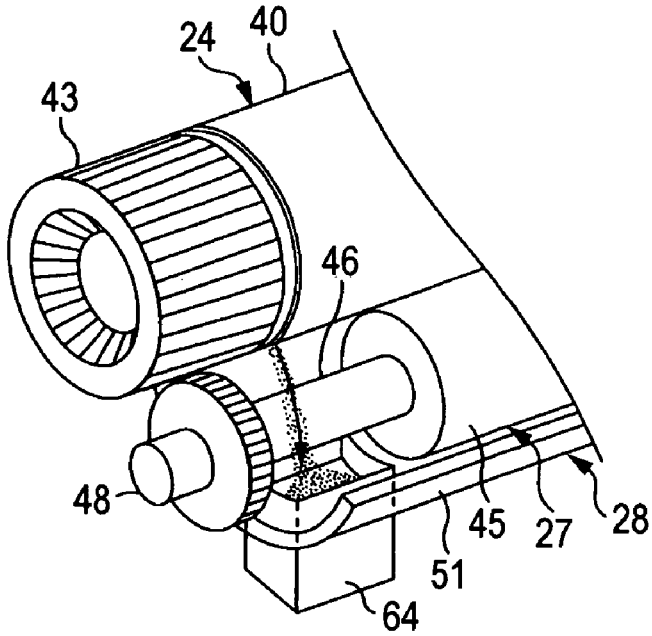
FIG. 11 is a main part perspective view showing the drum cartridge of the process cartridge (in a manner that toner reservoir parts are provided: transfer roller gear side)
Figure 12:
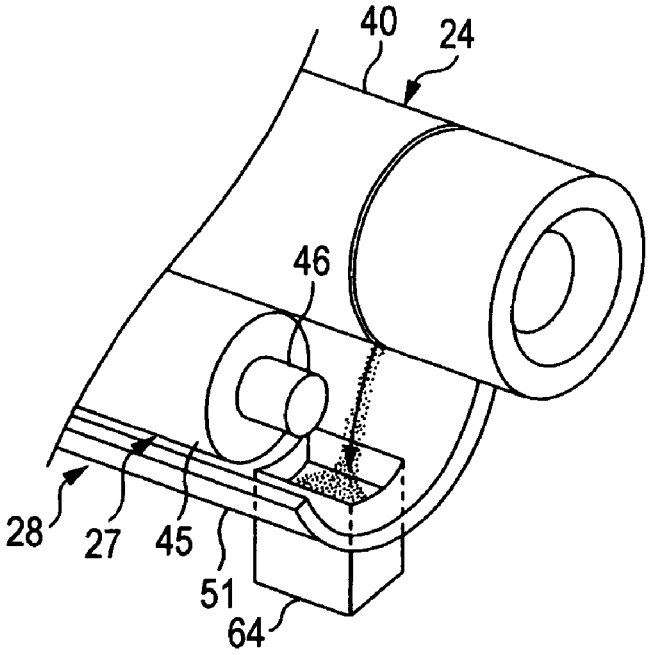
FIG. 12 is a main part perspective view showing the drum cartridge of the process cartridge (in a manner that toner reservoir parts are provided: the side opposite the transfer roller gear)

Furthermore, in the abovementioned process cartridge 14, as shown in FIG. 11 and FIG. 12, it is also possible that toner reservoir parts 64 as receiving members for receiving toner dropping from the drum main body 40 are formed in the lower cover member 28.

In FIG. 11 and FIG. 12, as in the case described above, the roller member 45 of the transfer roller 27 is formed so that its length in the axial direction is sufficiently shorter than the length in the axial direction of the drum main body 40 of the photoconductor drum 24, and above the roller member 45, the drum main body 40 is disposed along the axial direction of the roller member 45 so that both ends in the axial direction of the drum main body 40 are not opposite both ends in the axial direction of the roller member 45.

Then, the toner reservoir parts 64 are provided in the lower plate 51 of the lower cover member 28 at the both outer sides in the axial direction of the roller member 45 between the drum main body 40 and the lower plate 51, that is, the toner reservoir parts are provided below the drum main body 40 so as to be opposite each other at both ends in the axial direction of the drum main body 40 that are not opposite both ends in the axial direction of the roller member 45.

Each toner reservoir part 64 has a roughly rectangular shape in plan view, and is formed integrally with the lower plate 51 as a recess caving downward from the lower plate 51.

In this arrangement, as in the case described above, the length in the axial direction of the roller member 45 is formed to be sufficiently shorter than the length in the axial direction of the drum main body 40, so that the toner reservoir parts 64 can be disposed opposite each other at both ends in the axial direction of the drum main body 40 that are not opposite both ends in the axial direction of the roller member 45. Thereby, even when toner adhering to both ends in the axial direction of the drum main body 40 from both ends in the axial direction of the developing roller 31 drops, the toner can be directly received by the toner reservoir parts 64 without passing through both ends in the axial direction of the roller member 45. Therefore, stain on the roller member 45 can be reduced, and such a toner can be collected into the toner reservoir parts 64, so that the apparatus can be prevented from being stained by toner splatter.

Figure 13:
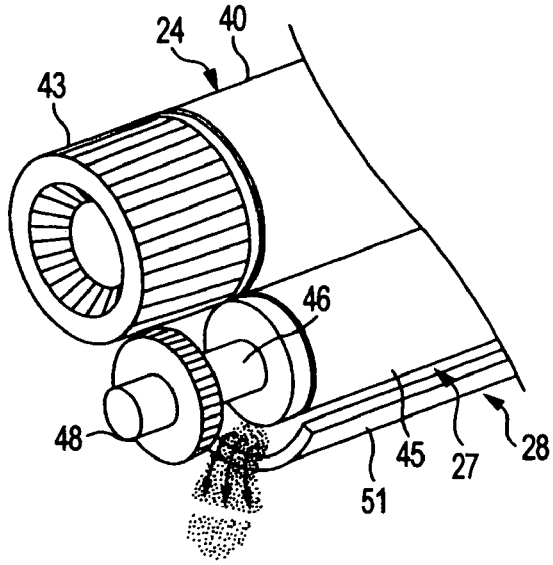
FIG. 13 is a main part perspective view showing the drum cartridge of the process cartridge (in a manner that the drum main body and the roller member are almost equal to each other in length in their axial directions)

Namely, as shown in FIG. 13, for example, the length in the axial direction of the drum main body 40 is almost equal to the length in the axial direction of the roller member 45, the toner dropping from the drum main body 40 adheres to the roller member 45, and when the toner drops from the roller member 45, the toner spills from the lower cover member 28 and splatters inside the apparatus.

However, as described above, the length in the axial direction of the roller member 45 is formed to be sufficiently shorter than the length in the axial direction of the drum main body 40 and both ends in the axial direction of the roller member 45 are disposed opposite both ends in the axial direction of the drum main body 40 that are not opposite both ends in the axial direction of the roller member 45, whereby the toner dropping from both ends in the axial direction of the drum main body 40 can be directly received by the toner reservoir parts 64. Therefore, the stain on the roller member 45 can be reduced, and the toner can be collected into the toner reservoir parts 64, so that the apparatus can be prevented from being stained by toner splatter.

In addition, in FIG. 11 and FIG. 12, the roller member 45 is formed to have a length within the range in which the drum main body 40 comes into contact with the layer thickness limiting blade 32, and disposed within the range.

Particularly, the toner reservoir parts 64 are disposed opposite each other at both ends in the axial direction of the roller member 45, so that the toner dropping from both ends in the axial direction of the drum main body 40 can be directly received by the toner reservoir parts 64. Therefore, the stain on the roller member 45 can be further reduced, whereby the apparatus can be prevented from being stained by toner splatter.

In addition, the toner reservoir parts 64 are provided integrally with the lower plate 51 of the lower cover member 28, so that the toner reservoir parts 64 can be easily formed in the arrangement enabling them to receive the toner without fail.

Furthermore, in the description given above, the transfer roller 27 and the lower cover member 28 are provided on the drum cartridge 22 and are made detachable from the main body casing 2 integrally with the process cartridge 14, however, it is also possible that the transfer roller 27 and the lower cover member 28 can be provided on, for example, the main body casing 2. In this case, the bearing members 50 and the toner reservoir parts 64 are also provided on the main body casing 2.

Figure 14:
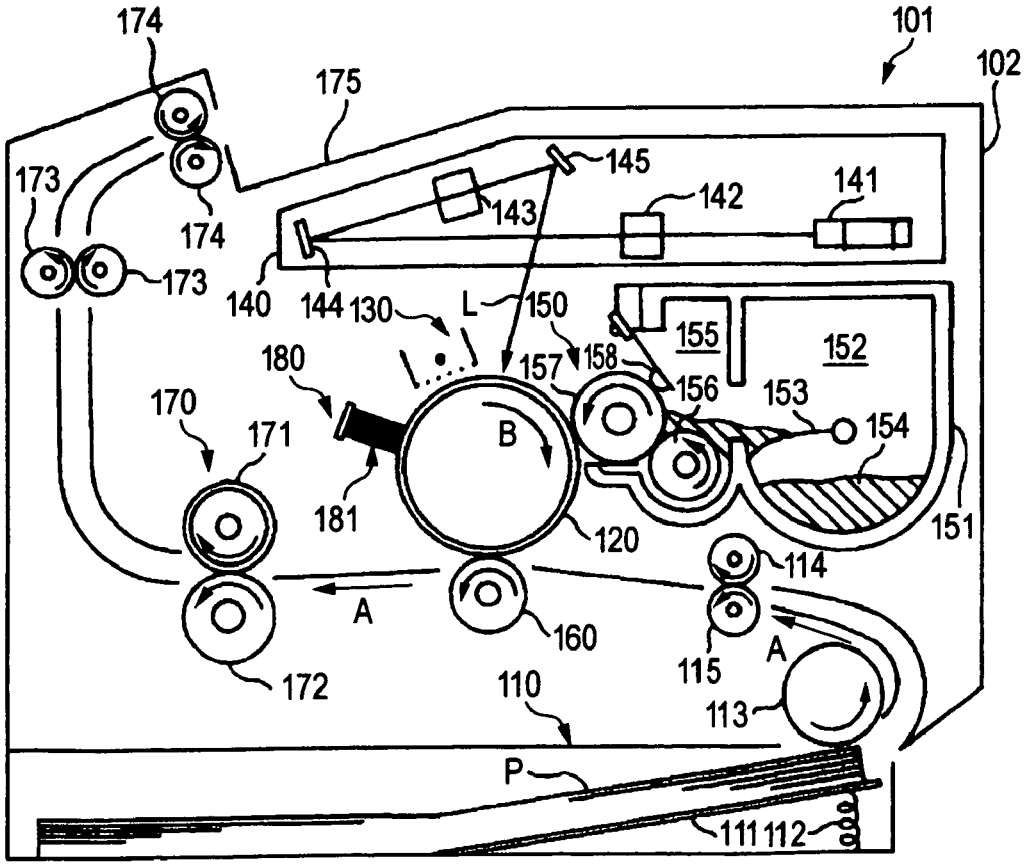
FIG. 14 is an explanatory view showing the schematic sectional configuration of the laser printer according to a second embodiment.
Figure 15:
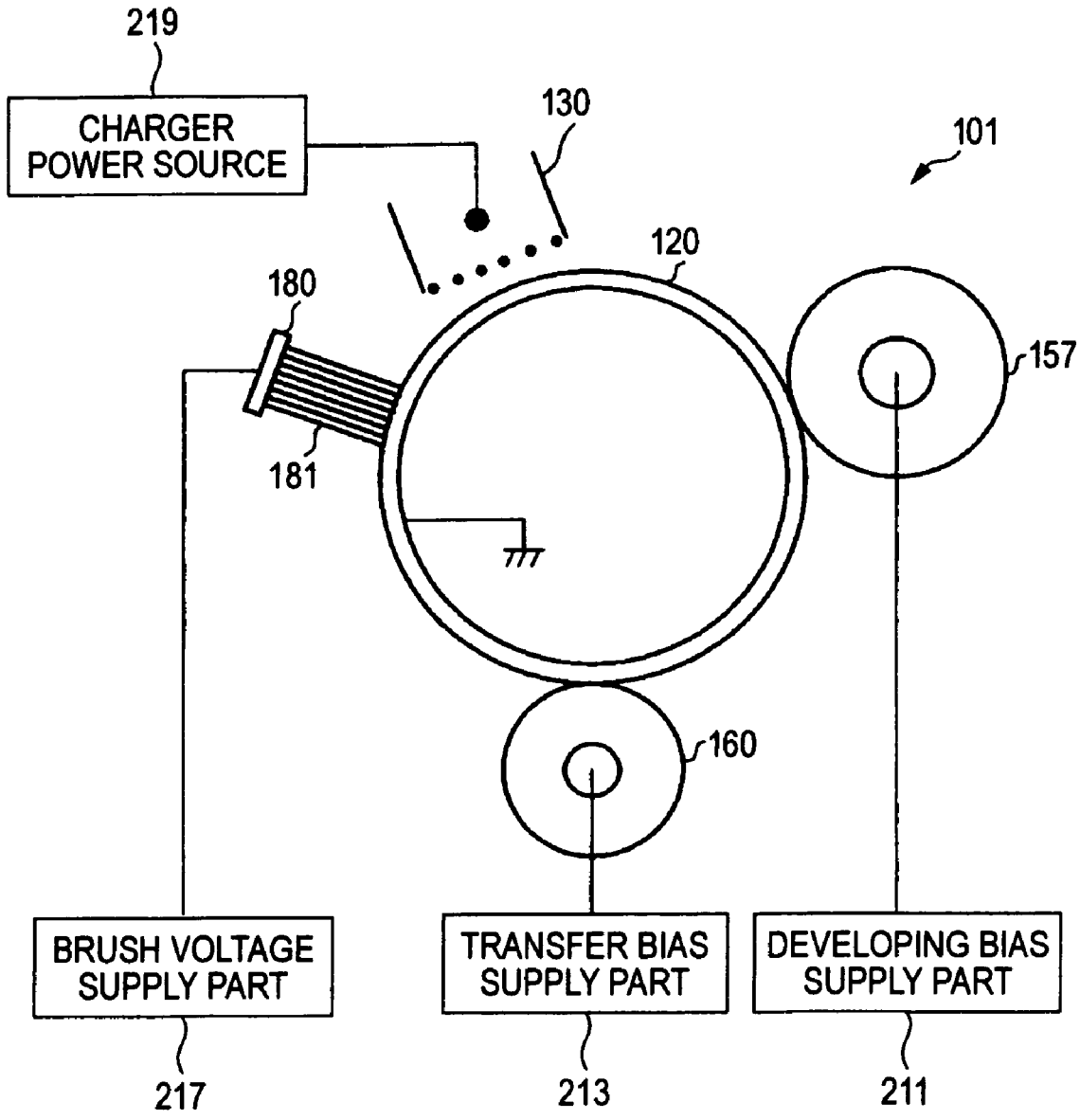
FIG. 15 is an explanatory view schematically showing the electrical configuration of the laser printer.

Hereinafter, a second embodiment of the invention is described with reference to the drawings. FIG. 14 is an explanatory view showing the schematic sectional configuration of a laser printer 101 as an electrophotographic image forming apparatus to which the invention is applied. FIG. 15 is a block diagram showing the electrical configuration of the laser printer 101.

The laser printer 101 shown in FIG. 14 has a feeder unit 110 for feeding a paper as a sheet at the bottom of the main body case 102. The feeder unit 110 includes a sheet pressing plate 111, a compression spring 112, and a sheet feed roller 113, and sheets P placed on the sheet pressing plate 111 are pressed against the sheet feed roller 113 by the pressing force of the compression spring 112, the top paper is separated by the rotation of the sheet feed roller 113 and supplied to the side of the resist rollers 114 and 115.

At the further downstream side in the sheet conveyance direction shown by the arrow A than the sheet feed roller 113, a pair of resist rollers 114 and 115 are pivotally supported in a rotatable manner to convey the paper to a transfer position formed by the photoconductor drum 120 and the transfer roller 160 in a predetermined timing.

The photoconductor drum 120 as an image carrier has an organic photoconductor mainly composed of a positively charged material, for example, positively charged polycarbonate. The photoconductor drum 120 is composed of a hollow drum which is formed of an aluminum-made cylindrical sleeve as its main body and has a photoconductive layer with a predetermined thickness made on its outer circumference by dispersing a photoconductive resin in polycarbonate, and is pivotally supported by the main body case 102 in a rotatable manner while the cylindrical sleeve is grounded. The photoconductor drum 120 rotates in the direction of the arrow B by receiving a driving force from a driving source such as a motor via a gear.

Furthermore, around the photoconductor drum 120, a charger 130 for evenly charging the surface of the photoconductor drum 120, a scanner unit 140 for irradiating the photoconductor drum 120 charged by the charger 130 with a laser beam L for forming an electrostatic latent image, a development unit 150 which develops the electrostatic latent image formed on the photoconductor drum 120 by the scanner unit 140 to form a toner image as a developer image on the photoconductor drum 120, a transfer roller 160 which transfers the toner image formed on the photoconductor drum 120 onto the paper, and a cleaning device 180 which has a cleaning brush 181 for removing paper powder adhering to the photoconductor drum 120 when transferring from the photoconductor drum 120.

Figure 16A:
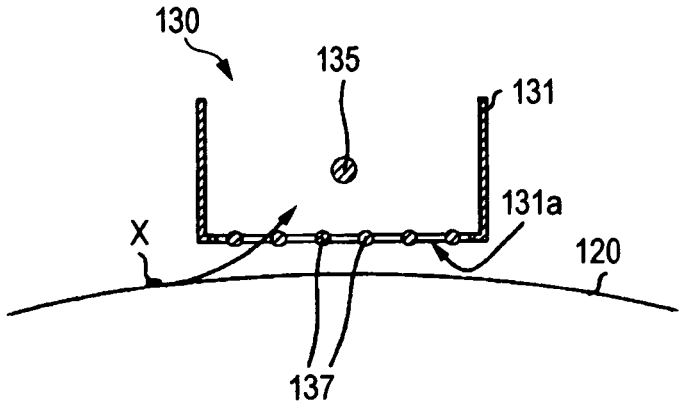
FIGS. 16A and 16B are a schematic sectional view and a plan view showing the configuration of a charger.
Figure 16B:
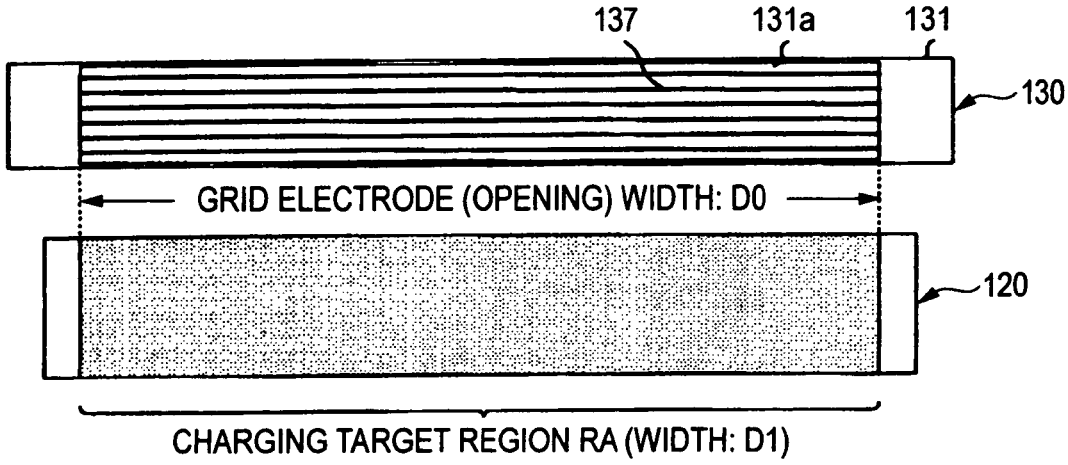

The charger 130 as a charging unit is formed of a scorotron type corona charger for positive charging including a discharging wire 135 and a grid electrode (wire) 137, and is disposed opposite the photoconductor drum 120 while leaving a predetermined clearance. FIG. 16A is an explanatory view showing the configuration of a vertical section to the rotation axis of the photoconductor drum 120 in this charger 130, and FIG. 16B is a plan view of the charger 130 along the rotation axis of the photoconductor drum 120.

The charger 130 has a discharging wire 135 inside a frame body 131 having an opening 131*a* disposed opposite the photoconductor drum 120, and in the opening 131*a*, a grid electrode 137 is laid. The charger 130 discharges corona ions from the discharging wire 135 by receiving a supply of electrical power from the charger power source 219. The corona ions discharged from the discharging wire 135 pass through the opening 131*a* and reach the photoconductor drum 120 to charge the surface of the photoconductor drum 120. At this point, the grid electrode 137 controls the charged state of the photoconductor drum 120 charged by the corona ions discharged from the discharging wire 135.

The charging target region RA on the photoconductor drum 120 which the charger 130 can charge matches the surface of the photoconductor drum 120 opposite the opening 131*a*, and the width D1 in the rotation axis direction of the photoconductor drum 120 of the charging target region RA matches the width D0 in the rotation axis direction of the photoconductor drum 120 in the opening 131*a*.

On the other hand, the scanner unit 140 as an exposure unit includes a laser generator (not shown) that generates a laser beam L for forming an electrostatic latent image on the photoconductor drum 120, a polygon mirror 141 to be driven to rotate, lenses 142 and 143, and reflecting mirrors 144 and 145, etc., and exposes the surface of the photoconductor drum 120 at an exposure position on the further downstream side in the rotation direction of the photoconductor drum 120 than the charger 130 by irradiating the surface of the photoconductor drum 120 with a laser beam L to form an electrostatic latent image on the surface of the photoconductor drum 120.

The development unit 150 has a developing roller 157 as a developing unit that is in contact with the photoconductor drum 120 at the further downstream side in the rotation direction of the photoconductor drum 120 than the exposure position. The developing roller 157 develops an electrostatic latent image formed on the photoconductor drum 120 by the scanner unit 140 by using a positively charged toner carried on the surface of the developing roller to form a toner image on the photoconductor drum 120.

The development unit 150 is configured so that a toner housing chamber 152 is formed inside the main body 151, and has an agitator 153 and a positively charged toner 154 (in detail, a polymer toner) inside the toner housing chamber 152. Adjacent to the toner housing chamber 152, a developing chamber 155 is provided, and to this developing chamber 155, a supply roller 156 and the developing roller 157 are pivotally supported in a rotatable manner.

The supply roller 156 is formed by covering a roller made of a conductive foaming material on a metallic shaft member, and the developing roller 157 is formed by coating a coating layer made of urethane rubber or silicone rubber containing fluorine on the surface of a roller main body made of conductive urethane rubber or silicone rubber containing carbon fine particles. These supply roller 156 and developing roller 157 are made pressure-contact with each other.

The toner 154 inside the toner housing chamber 152 is agitated by the rotation of the agitator 153 and supplied to the inside of the developing chamber 155, and positively frictionally charged between the supply roller 156 and the developing roller 157 and carried by the developing roller 157.

The toner 154 carried by the developing roller 157 is limited to a predetermined layer thickness by the layer thickness limiting blade 158, and supplied for development. The layer thickness limiting blade 158 is formed by providing a contact part made of a rubber material such as silicone rubber on the end of a leaf spring made of a plate of stainless steel, etc., and the contact part is pressed against the developing roller 157 by an elastic force of the leaf spring.

To the developing roller 157, a developing bias necessary for visualization of the electrostatic latent image is supplied from a developing bias supply part 211. According to supply of a developing bias, between the developing roller 157 and the photoconductor drum 120, an electrical field is formed in the direction of moving the toner 154 carried by the developing roller 157 to the electrostatic latent image formed on the photoconductor drum 120, and the toner 154 adhering to the developing roller 157 is used for development.

On the developing roller 157, the central region (width D2 in the axis direction) of the roller main body part 157*a* (see FIG. 18) is formed as an effective developing region in which the toner 154 can be applied to the photoconductor drum 120 (in other words, a region with the toner 154 adhering on the developing roller 157). Namely, in the laser printer 101, only the electrostatic latent image formed in the developing region RB (width D2 in the rotation axis direction of the photoconductor drum 120) on the photoconductor drum 120 opposite the effective developing region of the developing roller 157 is developed by the toner supplied from the developing roller 157.

Furthermore, the transfer roller 160 as a transfer unit is formed by covering a foaming elastic body (polyurethane, etc.) 160*a* that has ion conductivity and has a circular shape in section around a shaft member (see FIG. 18), and is pivotally supported in a rotatable manner at the further downstream side in the rotation direction of the photoconductor drum 120 than the position of contact between the developing roller 157 and the photoconductor drum 120 while the surface of the foaming elastic body 160*a* is in contact with the surface of the photoconductor drum 120. In addition, the transfer roller 160 rotates by following the photoconductor drum 120 upon receiving a driving force (frictional force) from the photoconductor drum 120 via the surface in contact with the photoconductor drum 120.

In addition, the transfer roller 160 draws the paper conveyed from the resist rollers 114 and 115 between the photoconductor drum 120 and the transfer roller 160 and makes the sheet to pass toward the fixing unit 170 side. When the paper passes between the transfer roller 160 and the photoconductor drum 120, a transfer bias necessary for transfer is supplied from the transfer bias supply part 213 to the transfer roller 160.

When a transfer bias is supplied to the transfer roller 160, the surface potential of the transfer roller 160 becomes lower than the surface potential of the photoconductor drum 120 immediately before the photoconductor drum comes into contact with the transfer roller 160, and the toner that separates from the photoconductor drum 120 adheres to the paper passing between the photoconductor drum 120 and the transfer roller 160. According to this method, the toner image is transferred. To the photoconductor drum 120, negatively polarized paper powder existing on the paper adheres.

In the transfer roller 160, the entire side surface region of the foaming elastic body 160*a* (width D3 in the axis direction) is formed as an effective transfer region (region in which the toner image can be transferred onto a sheet). Namely, in the laser printer 101, the toner image existing on the surface (transfer region RC: width D3) of the photoconductor drum 120 opposite the foaming elastic body 160*a* of the transfer roller 160 is transferred onto the sheet by the transfer roller 160 while passing between the transfer region RC and the transfer roller 160.

At the further downstream side in the paper conveyance direction (shown by the arrow A in FIG. 14) than the transfer position (the contact position between the photoconductor drum 120 and the transfer roller 160), a fixing unit 170 for fixing a toner image on the paper, a pair of conveyance roller 173 and paper eject roller 174 for sheet conveyance, and a paper output tray 175 are provided. The fixing unit 170 has a heating roller 171 and a pressing roller 172, and heat-fixes a toner image transferred onto the paper by pressing the sheet between the rollers 171 and 172 while heating by the heating roller 171. The conveyance roller 173 and the paper eject roller 174 are provided at the downstream side of the fixing unit 170 in the conveyance direction of the paper, and the paper output tray 175 is provided at the downstream side of the paper eject roller 174.

Figure 17:
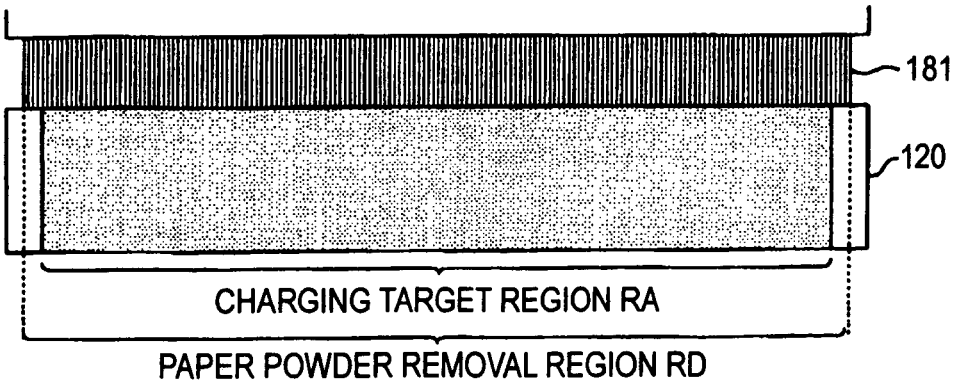
FIG. 17 is an explanatory view showing the contact state between a cleaning brush and a photoconductor drum.

A cleaning device 180 as a paper powder removal unit has the abovementioned conductive cleaning brush 181 formed by conductivity-processing fibers such as nylon, acryl, rayon, etc., and selectively removes paper powder on the photoconductor drum 120 negatively charged when transferring from the photoconductor drum 120 by using the cleaning brush 181. The cleaning brush 181 is disposed opposite and in contact with the photoconductor drum 120 at the side further downstream in the rotation direction of the photoconductor drum 120 than the transfer roller 160 (that is, the transfer position) and further upstream in the rotation direction of the photoconductor drum 120 than the charger 130. FIG. 17 is an explanatory view schematically showing the contact state between the cleaning brush 181 and the photoconductor drum 120.

To the cleaning brush 181, a predetermined voltage is applied by a brush voltage supply part 217 so that the potential of the brush is maintained higher than the surface potential of the photoconductor drum 120. Thereby, between the cleaning brush 181 and the surface of the photoconductor drum 120, an electrical field is formed in the direction of adsorbing negatively charged foreign objects to the cleaning brush 181. Therefore, when a voltage is applied to the cleaning brush 181 by the brush voltage supply part 217, to the cleaning brush 181, the positively charged remaining toner is not adsorbed but only negatively charged paper powder adhering to the photoconductor drum 120 is selectively adsorbed.

The paper powder removal region RD on the photoconductor drum 120 from which the cleaning device 180 can remove paper powder matches the surface of the photoconductor drum 120 which comes into contact with the cleaning brush 181. Namely, in the laser printer 101, paper powder existing in the paper powder removal region RD on the photoconductor drum 120 (width D4 in the rotation axis direction of the photoconductor drum 120) in contact with the cleaning brush 181 is collected by the cleaning brush 181.

The cleaning brush 181 adsorbs the paper powder as described above, and also, disperses the positively charged toner remaining on the photoconductor drum 120 after transferring on the photoconductor drum 120 so as to make it easy to collect the remaining toner by the development unit 150. The laser printer 101 is formed as a so-called cleaner-less laser printer, and the toner remaining on the photoconductor drum 120 after transferring by the transfer roller 160 is not collected by the cleaning unit 180, but is collected by using a developing roller 157 of the development unit 150 according to a method generally known.

Figure 18:
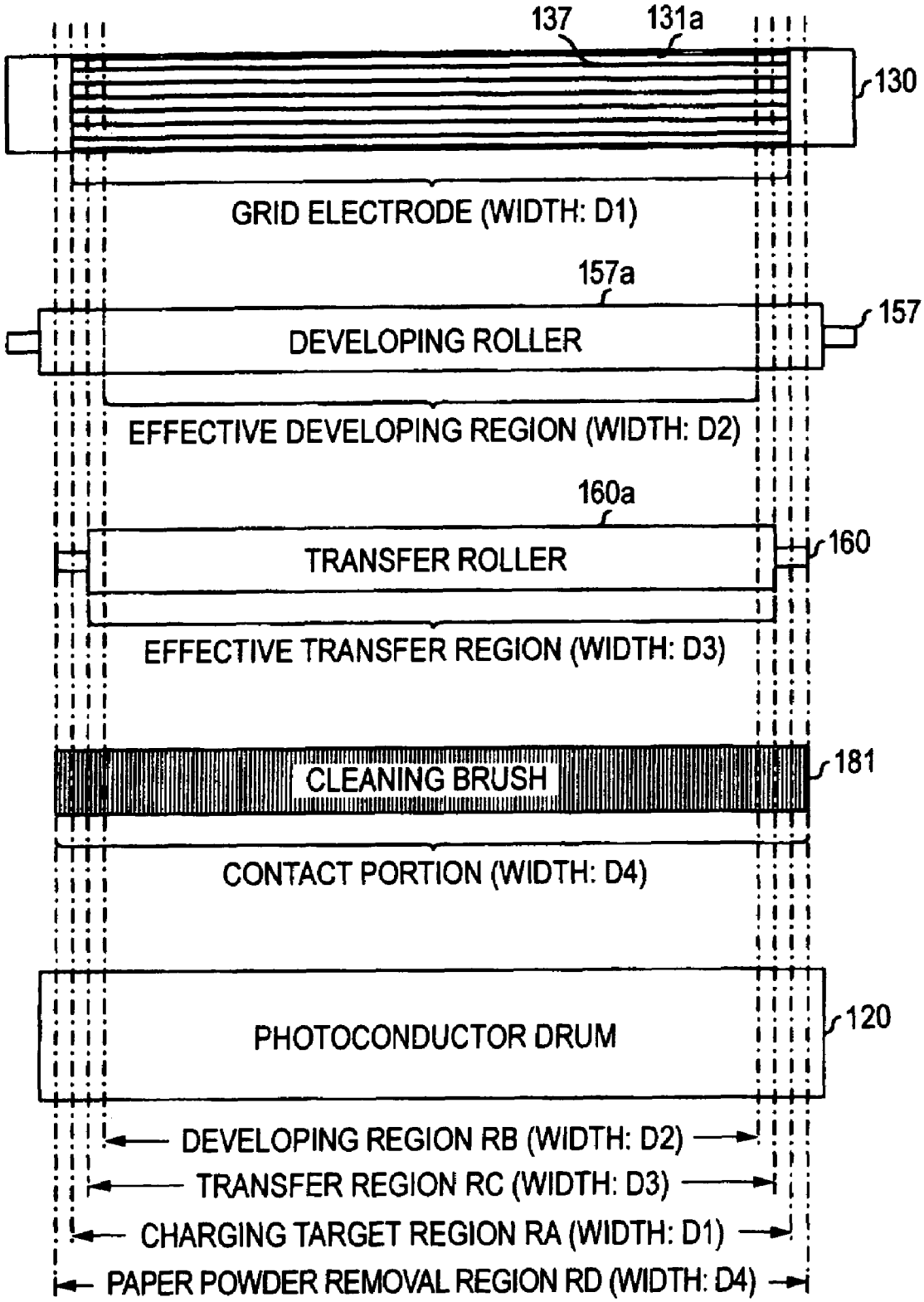
FIG. 18 is an explanatory view showing the relationship of the lengths of the charging target region RA, the developing region RB, the transfer region RC, and the paper powder removal region RD.

The widths of the abovementioned charging target region RA, the developing region RB, the transfer region RC, and the paper powder removal region RD are set as shown in FIG. 18. FIG. 18 is an explanatory view showing the relationship in length of the abovementioned charging target region RA, the developing region RB, the transfer region RC, and the paper powder removal region RD.

As shown in FIG. 18, in the laser printer 101 of the second embodiment, the width D1 of the charging target region RA in the rotation axis direction of the photoconductor drum 120, the width D2 of the developing region RB in the rotation axis direction of the photoconductor drum 120, the width D3 of the transfer region RC in the rotation axis direction of the photoconductor drum 120, and the width D4 of the paper powder removal region RD in the rotation axis direction of the photoconductor drum 120 are set so as to satisfy the following relationship (inequality).

$$D4>D1>D3>D2$$

In the laser printer 101, the paper powder removal region RD is set wider than the charging target region RA, the developing region RB, and the transfer region RC in the rotation axis direction of the photoconductor drum 120. In addition, the charging target region RA is set wider than the developing region RB and the transfer region RC in the rotation axis direction of the photoconductor drum 120. The transfer region RC is set wider than the developing region RB.

The laser printer 101 of the second embodiment has been described above, and according to the laser printer 101, the paper powder removal region RD (in other words, the length of the contact portion between the cleaning brush 181 and the photoconductor drum 120 in the rotation axis direction of the photoconductor drum 120) is set wider than the charging target region RA in the rotation axis direction of the photoconductor drum 120, so that paper powder can be completely removed from the surface of the photoconductor drum 120 corresponding to the charging target region RA by the cleaning brush 181, and it can be sufficiently prevented that the charger 130 deteriorates in performance and charging of the photoconductor drum 120 becomes incomplete due to abnormal discharge caused by adhesion of foreign objects X (paper powder) to the electrodes (grid electrode 137, discharging wire 135, etc.) of the charger 130 as shown in FIG. 16A.

Furthermore, when the cleaning unit 180 having the cleaning brush 181 as in this embodiment is used, the positively charged toner remaining after transferring can be effectively dispersed on the photoconductor drum 120 as well as removal of paper powder, and the collect rate of the toner by the development unit 150 can be increased. However, when such a cleaning brush 181 is used, paper powder accumulates on the cleaning brush 181 during a long period of use, and there is a possibility that a part of the paper powder splatters from both ends of the cleaning brush 181.

According to the second embodiment, the length of the cleaning brush 181 in the rotation axis direction of the photoconductor drum 120 is set wider than the charging object region RA (in other words, the opening 131*a* of the charger 130), so that it can be effectively prevented that a part of paper powder splattering from both ends of the cleaning brush 181 adheres to the discharging wire 135 through the opening 131*a* and causes abnormal discharge, etc.

Furthermore, even when the paper powder enters from the outside of the paper powder removal region RD, the paper powder removal region RD is set wider than the charging target region RA, so that the entering paper powder can be sufficiently prevented from harmfully influencing the charger 130.

In addition, according to the second embodiment, since the paper powder removal region RD is set wider than the developing region RB in which the toner is likely to remain after transferring, almost all the toner remaining on the photoconductor drum 120 can be dispersed by the cleaning brush 181, and the toner collect rate by the developing roller 157 is improved.

Furthermore, according to the second embodiment, since the paper powder removal region RD is set wider than the transfer region RC to which paper powder is likely to adhere when transferring (in other words, the length of the contact surface between the transfer roller 160 and the photoconductor drum 120 in the rotation axis direction of the photoconductor drum 120), the paper powder adhering to the photoconductor drum 120 can be effectively removed by the cleaning device 180, and the problem of abnormal discharge caused by paper powder can be satisfactorily solved.

Moreover, although discharge may occur when transferring if the transfer region RC is wider than the charging target region RA, however, according to the laser printer 101 of the second embodiment, the charging target region RA is set wider than the transfer region RC, so that such a problem is solved. In addition, since the transfer region RC is set wider than the developing region RB, the toner image formed on the photoconductor drum 120 can be excellently transferred onto the paper.

According to a first aspect of the invention, an image forming apparatus includes: a transfer member that transfers a developer image onto a transfer medium to form an image on the transfer medium; a bias applying unit that applies a transfer bias to the transfer member; and a bias control unit that controls the transfer bias to be applied to the transfer member by the bias applying unit, wherein a longitudinal length of the transfer member is formed to be shorter than a width of the transfer medium having a maximum width on which the image is to be formed with the image forming apparatus.

In the image forming apparatus according to the first aspect, the transfer bias control unit may control the bias applying unit so that a transfer bias is applied according to a control method differing depending on whether or not the width of the transfer medium to be used for transferring is equal to or longer than the longitudinal length of the transfer member.

According to the above configuration, the longitudinal length of the transfer member is formed to be shorter than the width of the transfer medium with a maximum width on which an image can be formed with this image forming apparatus, so that when the transfer medium to be used for transferring is a transfer medium with a maximum width, the transfer member comes into contact with the entirety in the longitudinal direction of the transfer medium. Furthermore, when the transfer medium to be used for transferring is a transfer medium with a width narrower than that of the transfer medium with the maximum width, in the longitudinal direction of the transfer member, the region that does not come into contact with the transfer medium is reduced to be smaller than in the case where the longitudinal length of the transfer member is formed to be longer than the width of the transfer medium with the maximum width. Therefore, when the width of the transfer medium to be used for transferring is equal to or longer than the longitudinal length of the transfer member, a transfer bias hardly leaks, and when it is shorter than the longitudinal length of the transfer member, the transfer bias leak can be reduced more than in the case where the longitudinal length of the transfer member is formed to be longer than the width of the transfer medium with the maximum width. As a result, even onto the transfer medium with a narrow width, a developer image can be transferred with a transfer current lower than in the conventional case. In this configuration, a transfer bias is applied by a control method that changes depending on whether or not the width of the transfer medium to be used for transferring is equal to or longer than the longitudinal length of the transfer member, so that only by simple control of switching the control method, a proper transfer bias is applied according to the ease of occurrence of transfer bias leak. Therefore, the apparatus damage caused by excessive application of a transfer current can be reduced while reducing a transfer failure caused by shortage in application of a transfer current.

The bias applying unit may be designed to selectively execute either one of constant current control and constant voltage control.

According to this configuration, since the bias applying unit can perform constant current control and constant voltage control, a proper transfer bias can be applied by selecting the constant current control or the constant voltage control depending on whether or not the width of the transfer medium to be used for transferring is equal to or longer than the longitudinal length of the transfer member by controlling the bias applying unit by the transfer bias control unit.

The transfer bias control unit may be configured to control the bias applying unit with a first control method when the width of the transfer medium to be used is equal to or longer than the longitudinal length of the transfer member, and to control the bias applying unit with a second control method when the width of the transfer medium to be used is shorter than the longitudinal length of the transfer member.

The first control method may be constant current control and the second control method may be constant voltage control.

According to this configuration, when the width of the transfer medium to be used for transferring is equal to or longer than the longitudinal length of the transfer member, a transfer bias is applied by constant current control, and when the width is shorter than the longitudinal length of the transfer member, a transfer bias is applied by constant voltage control. Therefore, when the width of the transfer medium to be used for transferring is equal to or longer than the longitudinal length of the transfer member, a necessary and sufficient transfer current can be applied by constant current control without fail, and when the width is shorter than the longitudinal length of the transfer member, leak of the transfer current can be compensated by constant voltage control, and a necessary and sufficient transfer current can be applied to the transfer medium without fail.

The first control method may be constant current control, and the second control method may be constant current control for controlling at a current value higher than that of the constant current control performed in the first control method.

According to this configuration, when the width of the transfer medium to be used for transferring is equal to or longer than the longitudinal length of the transfer member, a transfer bias is applied by constant current control, and when the width is shorter than the longitudinal length of the transfer member, a transfer bias is applied by constant current control in which control is performed with a current value higher than in the constant current control performed when the width of the transfer medium to be used for transferring is equal to or longer than the longitudinal length of the transfer member. Therefore, by simple control of changing the current value by constant current control depending on whether or not the width of the transfer medium to be used for transferring is equal to or longer than the longitudinal length of the transfer member, a proper transfer bias can be applied.

The first control method may be constant current control for controlling constantly at a constant value regardless of the width of the transfer medium, and the second control method may be constant current control in which a current value is changed according to the width of the transfer medium.

According to this configuration, when the width of the transfer medium to be used for transferring is equal to or longer than the longitudinal length of the transfer member, a transfer bias is applied with a constant current value by constant current control, and when the width is shorter than the longitudinal length of the transfer member, a transfer bias is applied while changing the current value according to the width of the transfer medium by constant current control. Therefore, depending on whether or not the width of the transfer medium to be used for transferring is equal to or longer than the longitudinal length of the transfer member, furthermore, when it is shorter than the longitudinal length of the transfer member, a transfer bias can be applied with a proper current value by constant current control according to the width of the transfer medium to be used for transferring.

The image forming apparatus according to the first aspect may further include: a developer carrier that carries a developer; an image carrier that is disposed opposite the developer carrier and carries an image of the developer; and a receiving member that receives from the developer carrier a developer adhering to both ends of the image carrier in a longitudinal direction of the image carrier, wherein the image carrier has a longitudinal length longer than that of the transfer member, and is disposed along the longitudinal direction of the transfer member above the transfer member so that at least either one of the longitudinal ends thereof is opposite the longitudinal end of the transfer member, and wherein the receiving member is disposed below the image carrier so as to be opposite each other at the longitudinal ends of the image carrier that are not opposite the longitudinal ends of the transfer member.

According to this configuration, since receiving members are disposed below the image carrier so as to be opposite each other at longitudinal ends of the image carrier that are not opposite the longitudinal ends of the transfer member, a developer adhering to the longitudinal ends of the image carrier from the developer carrier can be received by the receiving members without passing through the transfer member. Therefore, stain on the transfer member can be reduced, and such a developer can be collected into the receiving member, so that the apparatus can be prevented from being stained by developer splatter.

The image carrier may be disposed so that the both ends of the image carrier in the longitudinal direction are not opposite the both ends of the transfer member in the longitudinal direction, and wherein at least two of the receiving member are disposed respectively at positions opposite to both ends of the image carrier in the longitudinal direction of the image carrier.

According to this configuration, since the receiving members are disposed opposite each other at both longitudinal ends of the image carrier, a developer adhering to both longitudinal ends of the image carrier from the developer carrier can be received by the receiving members. Therefore, the stain on the transfer member can be further reduced, and the apparatus can be prevented more from being stained by developer splatter.

The image forming apparatus according to the first aspect may further include a cover member that covers the transfer member, wherein the receiving member is integrally provided on the cover member.

According to this configuration, since the receiving members are integrally provided on the cover member covering the transfer member, the receiving members can be easily formed in arrangement enabling them to receive the developer without fail.

The image forming apparatus according to the first aspect may further include: an image carrier on which a developer image is carried; a shaft member that supports the transfer member; and a bearing member that rotatably supports the shaft member, wherein a longitudinal length of the image carrier is formed to be longer than the longitudinal length of the transfer member, wherein the image carrier is disposed above the transfer member along the longitudinal direction of the transfer member so that at least either one of the longitudinal ends thereof is not opposite the longitudinal end of the transfer member, and wherein the bearing member is disposed below the image carrier so as to be opposite the longitudinal end of the image carrier that are not opposite the longitudinal ends of the transfer member.

According to this configuration, since the bearing members are disposed below the image carrier so as to be opposite each other at the longitudinal ends of the image carrier that are not opposite the longitudinal ends of the transfer member, the length in the axial direction of the shaft member supporting the transfer member can be shortened. Therefore, the apparatus can be downsized and lightened in weight.

The image forming apparatus according to the first aspect may further include: a first driving member that is provided on one end of the shaft member so as not to rotate relatively to the shaft member and drives the transfer member, wherein the first driving member is integrally provided with a sliding member to be slidably borne by the bearing member.

According to this configuration, since the first driving member for driving the transfer member is integrally provided with the sliding member, while the length in the axial direction of the shaft member can be shortened, the sliding member is easily formed integrally with the first driving member, whereby the assembling work can be made more efficient.

The sliding member and the bearing members may be made of a resin.

According to this configuration, the sliding member and bearing members are both made of a resin, so that smooth sliding is obtained and durability can be improved.

The image forming apparatus according to the first aspect may further include: an image carrier on which a developer image is carried; a second driving member that is provided at the longitudinal end of the image carrier and drives the image carrier; a shaft member that supports the transfer member; a first driving member that is provided on one end of the shaft member so as not to rotate relatively to the shaft member and drives the transfer member; and a power input member that inputs power into the second driving member, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap each other in the longitudinal direction of the transfer member.

According to this configuration, the longitudinal end of the image carrier where the second driving member is provided and the longitudinal end of the transfer member where the first driving member is provided are disposed so as not to be opposite each other, and the power input member and the first driving member are disposed so as to overlap in the longitudinal direction of the transfer member. Therefore, the apparatus can be downsized, and the degree of freedom in arrangement of the members can be increased.

The first driving member may be formed to be smaller than the power input member, and the power input member and the first driving member may be disposed so that a projection surface of the first driving member is disposed within a projection surface of the power input member in the longitudinal direction of the transfer member.

According to this configuration, the projection surface of the second driving member which is formed to be smaller than the power input member is disposed within the projection surface of the power input member in the longitudinal direction of the transfer member, so that the apparatus can be further downsized.

The image forming apparatus according to the first aspect may further include: an image carrier on which the developer image is carried; a shaft member that supports the transfer member; and a first driving member that is provided on one end of the shaft member so as not to rotate relatively to the shaft member and drives the transfer member, wherein a longitudinal length of the image carrier is formed to be longer than the longitudinal length of the transfer member, and wherein the image carrier is disposed above the transfer member along the longitudinal direction of the transfer member at the other end of the shaft member opposite one end of the shaft member where the first driving member is provided so that the longitudinal end of the image carrier is not opposite the longitudinal end of the transfer member.

According to this configuration, the image carrier is formed so that the longitudinal length of the image carrier is longer than the longitudinal length of the transfer member, and is disposed so that, on the other end of the shaft member opposite one end of the shaft member where the first driving member is provided, the longitudinal end of the image carrier is not opposite the longitudinal end of the transfer member. Therefore, the phenomenon in that the toner dropping from the image carrier adheres to the other end of the shaft member where the first driving member is not provided can be reduced.

According to a second aspect of the invention, the process cartridge includes: a developer carrier that carries a developer; an image carrier that is disposed opposite the developer carrier and carries a developer image; a transfer member that transfers the developer image onto a transfer medium, and is detachably attached to an image forming apparatus; and a receiving member that receives the developer adhering to both longitudinal ends of the image carrier from the developer carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal ends of the transfer member, wherein the receiving member is disposed below the image carrier so as to be opposite each other at the longitudinal ends of the image carrier that are not opposite the longitudinal ends of the transfer member.

According to this configuration, the receiving members are disposed below the image carrier so as to be opposite each other at the longitudinal ends of the image carrier that are not opposite the longitudinal ends of the transfer member, so that the developer adhering to the longitudinal ends of the image carrier from the developer carrier can be received by the receiving members without passing through the transfer member. Therefore, the stain on the transfer member can be reduced, and in addition, since such developer can be collected into the receiving members, the apparatus can be prevented from being stained by developer splatter.

According to a third aspect of the invention, the image forming apparatus includes: a developer carrier that carries a developer; an image carrier that is disposed opposite the developer carrier and carries the developer image; a transfer member that transfers a developer image onto a transfer medium;

and a receiving member that receives a developer adhering to both longitudinal ends of the image carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends thereof is not opposite the longitudinal ends of the transfer member, and wherein the receiving member is disposed below the image carrier so as to be opposite the transfer member and at the longitudinal end of the image carrier that are not opposite-the longitudinal ends of the transfer member.

According to this configuration, since the receiving members are disposed below the image carrier so as to be opposite each other at the longitudinal ends of the image carrier that are not opposite the longitudinal ends of the transfer member, the developer adhering to the longitudinal ends of the image carrier from the developer carrier can be received by the receiving members without passing through the transfer member. Therefore, the stain on the transfer member can be reduced, and in addition, since such a developer can be collected into the receiving members, the apparatus can be prevented from being stained by developer splatter.

According to a fourth aspect of the invention, the process cartridge includes: an image carrier that carries a developer image; a transfer member that transfers a developer image onto a transfer medium; a shaft member that supports the transfer member; and a bearing member that rotatably supports the shaft member and is detachably attached to an image forming apparatus, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal ends of the transfer member, and wherein the bearing member is disposed below the image carrier so as to be opposite the image carrier at the longitudinal ends of the image carrier that are not opposite the longitudinal ends of the transfer member.

According to this configuration, since the bearing members are disposed below the image carrier so as to be opposite each other at the longitudinal ends of the image carrier that are not opposite the longitudinal ends of the transfer member, the length in the axial direction of the shaft member supporting the transfer member can be shortened. Therefore, the apparatus can be downsized.

According to a fifth aspect of the invention, the image forming apparatus includes: an image carrier on which a developer image is carried; a transfer member that transfers a developer image onto a transfer medium; a shaft member that supports the transfer member; and a bearing member that rotatably supports the shaft member, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the longitudinal end of the transfer member, and wherein the bearing member is disposed below the image carrier so as to be opposite the image carrier at the longitudinal ends of the image carrier that are not opposite the longitudinal ends of the transfer member.

According to this configuration, since the bearing members are disposed below the image carrier so as to be opposite each other at the longitudinal ends of the image carrier that are not opposite the longitudinal ends of the transfer member, the length in the axial direction of the shaft member supporting the transfer member can be shortened. Therefore, the apparatus can be downsized.

According to a sixth aspect of the invention, the process cartridge includes: an image carrier that carries a developer image; a second driving member that is provided at the longitudinal end of the image carrier and drives the image carrier; a transfer member that transfers a developer image onto a transfer medium; a shaft member that supports the transfer member; a first driving member that is provided at one end of the shaft member so as not to rotate relatively to the shaft member and drives the transfer member; and a power input member that inputs power into the second driving member, and is detachably attached to an image forming apparatus, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap in the longitudinal direction of the transfer member.

According to this configuration, the longitudinal end of the image carrier where the second driving member is provided and the longitudinal end of the transfer member where the first driving member is provided are disposed so as not to be opposite each other, and the power input member and the first driving member are disposed so as to overlap in the longitudinal direction of the transfer member. Therefore, the apparatus can be downsized, and the degree of freedom in arrangement of the members can be increased.

According to a seventh aspect of the invention, the image forming apparatus includes: an image carrier that carries a developer image; a second driving member that is provided on the longitudinal end of the image carrier and drives the image carrier; a transfer member that transfers the developer image onto a transfer medium; a shaft member that supports the transfer member; a first driving member that is provided on one end of the shaft member so as not to rotate relatively to the shaft member and drives the transfer member; and a power input member that inputs power into the second driving member, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap in the longitudinal direction of the transfer member.

According to this configuration, the longitudinal end of the image carrier where the second driving member is provided and the longitudinal end of the transfer member where the first driving member is provided are disposed so as not to be opposite each other, and the power input member and the first driving member are disposed so as to overlap each other in the longitudinal direction of the transfer member. Therefore, the apparatus can be downsized, and the degree of freedom in arrangement of the members can be increased.

According to an eighth aspect of the invention, the image forming apparatus includes: an image carrier that is rotatably provided; a charging unit that is disposed opposite the image carrier, and charges a charging target region on a surface of the image carrier; an exposure unit that exposes the image carrier at an exposure position positioned at a downstream side in the rotation direction of the image carrier than the charging unit to form an electrostatic latent image on the image carrier; a developing unit that is disposed opposite the image carrier at the downstream side in the rotation direction of the image carrier than the exposure position, and develops an electrostatic latent image that is formed on the image carrier by the exposure unit by applying a developer with charge to form a developer image on the image carrier; a transfer unit that is disposed opposite the image carrier at the downstream side in the rotation direction of the image carrier than the developing unit, and transfers the developer image formed on the image carrier onto a transfer medium; and a paper powder removal unit that is disposed opposite the image carrier at a position downstream in the rotation direction of the image carrier than the transfer position of the transfer unit and upstream than the charging unit, and removes paper powder adhering to the image carrier from the image carrier, wherein the transfer unit collects a developer remaining on the image carrier after transferring by the transfer unit, and wherein a paper powder removal region from which the paper powder removal unit removes paper powder on the image carrier is set wider in the rotation axis direction of the image carrier than the charge target region.

In the image forming apparatus thus configured, the paper powder removal region is set wider than the charging target region, so that paper powder can be completely removed from the surface of the image carrier corresponding to the charging target region by using the paper powder removal unit, and it can be sufficiently prevented that the paper powder adheres to the electrodes of the charging unit and causes abnormal discharge, deteriorates the performance of the charging unit, and makes charging of the image carrier incomplete. In detail, for example, even when paper powder enters from the outside of the paper powder removal region, since the paper powder removal region is wider than the charging target region, the paper powder that has entered can be sufficiently prevented from harmfully influencing the charging unit.

As the charging unit, a corona charger that has a grid electrode at an opening for discharging corona ions is known. In this type of charger, the width of the grid electrode (opening) in the rotation axis direction of the image carrier matches the width of the charging target region in the rotation axis direction of the image carrier. Therefore, when the charging unit is a charger having a grid electrode at its opening, the paper powder removal region is set wider in the rotation axis direction of the image carrier than the grid electrode (opening).

The paper powder removal region may be set wider in the rotation axis direction of the image carrier than a developing region on the image carrier to which the developing unit applies a developer. According to this configuration, after transferring, the developer remaining on the image carrier is dispersed on the image carrier by receiving power from the paper powder removal unit when the paper powder removal unit removes paper powder from the image carrier, and becomes easy to separate from the image carrier and becomes easy to be collected by the developing unit.

According to this configuration, since the paper powder removal region is set wider than the developing region in which the developer may remain after transferring, almost all the developer remaining on the image carrier can be dispersed by the paper powder removal unit, and the collect rate of the developer by the developing unit is improved.

The charging target region may be set wider in the rotation axis direction of the image carrier than a developing region on the image carrier to which the developing unit applies a developer. Accordingly, the entire developing region can be sufficiently charged by the charging unit.

The paper powder removal region may be set wider in the rotation axis direction of the image carrier than a transfer region on the image carrier in which a developer image is to be transferred by the transfer unit onto a sheet. When the transfer unit transfers a developer image formed on the image carrier onto a sheet, powder adheres to the transfer region on the image carrier.

By setting the paper powder removal region wider than the transfer region, paper powder can be removed from the entire region of the image carrier where paper powder is likely to adhere, so that the problem of abnormal discharge from the charging unit due to paper powder can be satisfactorily solved.

When a transfer member (transfer roller, transfer belt, etc.,) that comes into contact with the image carrier is used as the transfer unit and the width of the surface of the transfer member in contact with the image carrier in the rotation axis direction of the image carrier matches the width of the transfer region in the rotation axis direction of the image carrier, the paper powder removal region is set wider than the length of the surface of the transfer member in contact with the image carrier in the rotation axis direction of the image carrier.

The charging target region may be set wider in the rotation axis direction of the image carrier than a transfer region on the image carrier in which a developer image is to be transferred onto a sheet by the transfer unit, and the transfer region may be set wider in the rotation axis direction of the image carrier than a developing region on the image carrier to which the developing unit applies a developer. Namely, the widths of the paper powder removal region, the charging target region, the transfer region, and the developing region in the rotation axis direction of the image carrier are set so as to satisfy the relationship of the paper powder removal region>the charging target region>the transfer region>the developing region.

By setting the widths the paper powder removal region as above, the charging target region, the transfer region, and the developing region becomes very preferable since the setting provides a plurality of effects described as follows.

Namely, in the image forming apparatus thus configured, since the paper powder removal region is wider than the developing region, almost all the developer remaining on the image carrier can be dispersed by the paper powder removal unit, and the collect rate of the developer by the developing unit can be improved. Furthermore, since the charging target region is wider than the developing region, the entire developing region can be sufficiently charged by the charging unit.

In addition, since the paper powder removal region is wider than the transfer region, the paper powder can be removed from the entire region of the image carrier where the paper powder is likely to adhere, and the problem of abnormal discharge from the charging unit due to the paper powder can be sufficiently solved.

In addition, discharge may occur when transferring if the transfer region is wider than the charging target region, however, in the image forming apparatus configured above, the charging target region is set wider than the transfer region, so that such a problem can be solved. Furthermore, since the transfer region is set wider than the developing region, a developer image formed on the image carrier can be excellently transferred onto a sheet.

The paper powder removal unit may be configured to have a brush disposed opposite the image carrier, and removes paper powder adhering to the image carrier from the image carrier with the brush.

When the paper powder removal unit is configured so as to remove paper powder from the image carrier by using a brush, paper powder can be effectively removed from the image carrier and a developer remaining on the image carrier after transferring can be effectively dispersed, and the remaining developer can be effectively collected by the developing unit. In the case of this paper powder removal unit, when paper powder accumulates on the brush during a long period of use, a part of the accumulating paper powder may splatter from both ends of the brush in the rotation axis direction of the image carrier, however, according to the invention, since the paper powder removal region is wider than the charging target region, that is, the length of the brush in the rotation axis direction of the image carrier is wider than the charging target region, a part of paper powder splattering from both ends of the brush can be sufficiently prevented from adhering to the electrodes of the charging unit and causing abnormal discharge, etc.

In the above configured image forming apparatus, the developer may be a positively charged toner. The paper powder is mainly negatively charged, and therefore, by using a toner positively charged reverse to the polarity of the paper powder, paper powder collection can be effectively carried out by the paper powder removal unit, and the toner remaining on the image carrier after transferring can be efficiently dispersed and collected by the developing unit.

Furthermore, when a positively charged toner is used as the developer, the paper powder removal unit can be configured to have a conductive brush disposed opposite the image carrier, and selectively removes paper powder adhering to the image carrier from the image carrier by maintaining the potential of the brush higher than the surface potential of the image carrier by applying a predetermined voltage to the brush.

In the image forming apparatus thus configured, since the potential of the brush is set higher than the surface potential of the image carrier, negatively charged paper powder adhering to the image carrier when transferring can be adsorbed by the brush, and the positively charged toner can be efficiently dispersed by electrical power.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus for forming an image on a sheet comprising:

a transfer member that transfers a developer image onto the sheet to form the image on the sheet and comes in contact with the sheet when the developer image is transferred onto the sheet;

a bias applying unit that applies a transfer bias to the transfer member;

a selection unit that selects a width of the sheet; and a transfer bias control unit that controls the transfer bias to be applied to the transfer member by the bias applying unit, wherein a longitudinal length of the transfer member is formed to be shorter than a width of the sheet having a maximum width on which the image is to be formed with the image forming apparatus, the transfer bias control unit controls the bias applying unit so that a transfer bias is applied according to a control method differing depending on whether or not the width of the sheet to be used for transferring is longer than the longitudinal length of the transfer member, the transfer bias control unit controls the bias applying unit with a first control method when the width of the sheet to be used is longer than the longitudinal length of the transfer member, and controls the bias applying unit with a second control method when the width of the sheet to be used is shorter than the longitudinal length of the transfer member, and a switching element that switches the transfer bias control unit between a constant current control and a constant voltage control in accordance with the selected width of the sheet.

2. The image forming apparatus according to claim 1, wherein the first control method is constant current control, and the second control method is constant current control for controlling at a current value higher than that of the constant current control performed in the first control method.

3. The image forming apparatus according to claim 2, wherein the first control method is constant current control for controlling constantly at a constant value regardless of the width of the sheet, and the second control method is constant current control in which a current value is changed according to the width of the sheet.

4. The image forming apparatus according to claim 1, further comprising:

a developer carrier that carries a developer;

an image carrier that is disposed opposite the developer carrier and carries an image of the developer; and a receiving member that receives from the developer carrier a developer adhering to both ends of the image carrier in a longitudinal direction of the image carrier, wherein the image carrier has a longitudinal length longer than that of the transfer member, and is disposed along the longitudinal direction of the transfer member above the transfer member so that at least either one of the longitudinal ends thereof is not opposite the longitudinal end of the transfer member, and wherein the receiving member is disposed below the image carrier so as to be opposite each other at the longitudinal ends of the image carrier that is not opposite the at least either one of the longitudinal ends of the transfer member.

5. The image forming apparatus according to claim 4, wherein the image carrier is disposed so that the both ends of the image carrier in the longitudinal direction are not opposite the both ends of the transfer member in the longitudinal direction, and wherein at least two of the receiving member are disposed respectively at positions opposite to both ends of the image carrier in the longitudinal direction of the image carrier.

6. The image forming apparatus according to claim 4, further comprising a cover member that covers the transfer member, wherein the receiving member is integrally provided on the cover member.

7. The image forming apparatus according to claim 1, further comprising:

an image carrier on which a developer image is carried;

a shaft member that supports the transfer member; and a bearing member that rotatably supports the shaft member, wherein a longitudinal length of the image carrier is formed to be longer than the longitudinal length of the transfer member, wherein the image carrier is disposed above the transfer member along the longitudinal direction of the transfer member so that at least either one of the longitudinal ends thereof is not opposite the longitudinal end of the transfer member, and wherein the bearing member is disposed below the image carrier so as to be opposite the longitudinal end of the image carrier that is not opposite the at least either one of the longitudinal ends of the transfer member.

8. The image forming apparatus according to claim 7, further comprising a first driving member that is provided on one end of the shaft member so as not to rotate relative to the shaft member and drives the transfer member, wherein the first driving member is integrally provided with a sliding member to be slidably borne by the bearing member.

9. The image forming apparatus according to claim 8, wherein the sliding member and the bearing members are made of a resin.

10. The image forming apparatus according to claim 1, further comprising:

an image carrier on which a developer image is carried;

a second driving member that is provided at the longitudinal end of the image carrier and drives the image carrier;

a shaft member that supports the transfer member;

a first driving member that is provided on one end of the shaft member so as not to rotate relative to the shaft member and drives the transfer member; and a power input member that inputs power into the second driving member, wherein a longitudinal length of the image carrier is formed to be longer than the longitudinal length of the transfer member, wherein the image carrier is disposed above the transfer member along the longitudinal direction of the transfer member so that the longitudinal end where the second driving member is provided is not opposite the longitudinal end of the transfer member where the first driving member is provided, and wherein the power input member and the first driving member are disposed so as to overlap each other in the longitudinal direction of the transfer member.

11. The image forming apparatus according to claim 10, wherein the first driving member is formed to be smaller than the power input member, and wherein the power input member and the first driving member are disposed so that a projection surface of the first driving member is disposed within a projection surface of the power input member in the longitudinal direction of the transfer member.

12. The image forming apparatus according to claim 1, further comprising:

an image carrier on which the developer image is carried;

a shaft member that supports the transfer member; and a first driving member that is provided on one end of the shaft member so as not to rotate relative to the shaft member and drives the transfer member, wherein a longitudinal length of the image carrier is formed to be longer than a longitudinal length of the transfer member, and wherein the image carrier is disposed above the transfer member along the longitudinal direction of the transfer member, and is disposed so that a longitudinal end of the image carrier does not oppose a longitudinal end of the transfer member at the one end of the shaft member where the first driving member is provided.

13. The image forming apparatus according to claim 1, further comprising:

an image carrier that is rotatably provided;

a charging unit that is disposed opposite the image carrier, and charges a charging target region on a surface of the image carrier;

an exposure unit that exposes the image carrier at an exposure position positioned at a downstream side, in a feed direction of the sheet, of a rotation axis of the image carrier than the charging unit to form an electrostatic latent image on the image carrier; and a developing unit that is disposed opposite the image carrier at the downstream side of the rotation axis of the image carrier than the exposure position, and develops the electrostatic latent image that is formed on the image earner by the exposure unit by applying a developer with charge to form a developer image on the image carrier, wherein the transfer unit is disposed opposite the image carrier at the downstream side of the rotation axis of the image carrier than the developing unit, and transfers the developer image formed on the image carrier onto the sheet, and wherein the image forming apparatus further comprising a paper powder removal unit that is disposed opposite the image carrier at a position downstream of the rotation direction of the image carrier than the transfer position of the transfer unit and upstream than the charging unit, and removes paper powder adhering to the image carrier from the image carrier, wherein the transfer unit collects a developer remaining on the image carrier after transferring by the transfer unit, and wherein a paper powder removal region from which the paper powder removal unit removes paper powder on the image carrier is set wider in a rotation axis direction of the image carrier than the charge target region.

14. The image forming apparatus according to claim 13, wherein the paper powder removal region is set wider in the rotation axis direction of the image carrier than a developing region on the image carrier to which the developing unit applies a developer.

15. The image forming apparatus according to claim 13, wherein the charging target region is set wider in the rotation axis direction of the image carrier than a developing region on the image carrier to which the developing unit applies a developer.

16. The image forming apparatus according to claim 13, wherein the paper powder removal region is set wider in the rotation axis direction of the image carrier than a transfer region on the image carrier in which a developer image is to be transferred by the transfer unit onto a sheet.

17. The image forming apparatus according to claim 13, wherein the charging target region is set wider in the rotation axis direction of the image carrier than a transfer region on the image carrier in which a developer image is to be transferred onto a sheet by the transfer unit, and wherein the transfer region is set wider in the rotation axis direction of the image carrier than a developing region on the image carrier to which the developing unit applies a developer.

18. The image forming apparatus according to claim 13, wherein the paper powder removal unit has a brush disposed opposite the image carrier, and removes paper powder adhering to the image carrier from the image carrier with the brush.

19. The image forming apparatus according to claim 13, wherein the developer is a positively charged toner.

20. The image forming apparatus according to claim 13, wherein the developer is a positively charged toner, and wherein the paper powder removal unit has a conductive brush disposed opposite the image carrier, and selectively removes paper powder adhering to the image carrier from the image carrier by maintaining a potential of the brush higher than a surface potential of the image carrier by applying a predetermined voltage to the brush.

21. A process cartridge comprising:

a developer carrier that carries a developer;

an image carrier that is disposed opposite the developer carrier and carries a developer image;

a transfer member that transfers the developer image onto a sheet, and is detachably attached to an image forming apparatus; and a receiving member that receives the developer adhering to both longitudinal ends of the image carrier from the developer carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends is not opposite the at least either one of the longitudinal ends of the transfer member, wherein the receiving member is disposed below the image carrier so as to be opposite each other at the longitudinal ends of the image carrier that is not opposite the at least either one of the longitudinal ends of the transfer member.

22. An image forming apparatus comprising:

a developer carrier that carries a developer;

an image carrier that is disposed opposite the developer carrier and carries the developer image;

a transfer member that transfers a developer image onto a sheet; and a receiving member that receives a developer adhering to both longitudinal ends of the image carrier, wherein a longitudinal length of the image carrier is formed to be longer than the longitudinal length of the transfer member, wherein the image carrier is disposed above the transfer member along the longitudinal direction of the transfer member so that at least either one of the longitudinal ends thereof is not opposite the longitudinal ends of the transfer member, and wherein the receiving member is disposed below the image carrier so as to be opposite the transfer member and at the longitudinal end of the image carrier that is not opposite the at least either one of the longitudinal ends of the transfer member.

23. A process cartridge comprising:

an image carrier that carries a developer image;

a second driving member that is provided at a longitudinal end of the image carrier and drives the image carrier;

a transfer member that transfers the developer image onto a sheet;

a shaft member that supports the transfer member;

a first driving member that is provided at one end of the shaft member so as not to rotate relative to the shaft member and drives the transfer member; and a power input member that inputs power into the second driving member, and is detachably attached to an image forming apparatus, wherein a longitudinal length of the image carrier is formed to be longer than a longitudinal length of the transfer member, wherein the image carrier is disposed above the transfer member along the longitudinal direction of the transfer member so that the longitudinal end of the image carrier, where the second driving member is provided, is not opposite a longitudinal end of the transfer member where the first driving member is provided, and wherein the power input member and the first driving member are disposed so as to overlap in the longitudinal direction of the transfer member and side plates are provided between the first driving member and the power input member.

24. An image forming apparatus comprising:

an image carrier that carries a developer image;

a second driving member that is provided on a longitudinal end of the image carrier and drives the image carrier;

a transfer member that transfers the developer image onto a sheet;

a shaft member that supports the transfer member;

a first driving member that is provided on one end of the shaft member so as not to rotate relative to the shaft member and drives the transfer member; and a power input member that inputs power into the second driving member, wherein a longitudinal length of the image carrier is formed to be longer than a longitudinal length of the transfer member, wherein the image carrier is disposed above the transfer member along the longitudinal direction of the transfer member so that the longitudinal end of the image carrier, where the second driving member is provided, is not opposite the longitudinal end of the transfer member where the first driving member is provided, and wherein the power input member and the first driving member are disposed so as to overlap in the longitudinal direction of the transfer member and side plates are provided between the first driving member and the power input member.

25. An image forming apparatus for forming an image on a sheet comprising:

an image carrier that is rotatably provided;

a charging unit that is disposed opposite the image carrier, and charges a charging target region on a surface of the image carrier;

an exposure unit that exposes the image carrier at an exposure position positioned at a downstream side, in a feed direction of the sheet, of a rotation axis of the image carrier than the charging unit to form an electrostatic latent image on the image carrier;

a developing unit that is disposed opposite the image carrier at the downstream side of the rotation axis of the image carrier than the exposure position, and develops the electrostatic latent image that is formed on the image carrier by the exposure unit by applying a developer with charge to form a developer image on the image carrier;

a transfer unit that is disposed opposite the image carrier at the downstream side of the rotation axis of the image carrier than the developing unit, and transfers the developer image formed on the image carrier onto the sheet; and a paper powder removal unit that is disposed opposite the image carrier at a position downstream of the rotation axis of the image carrier than a transfer position of the transfer unit and upstream than the charging unit, and removes paper powder adhering to the image carrier from the image carrier;

wherein the transfer unit collects a developer remaining on the image carrier after transferring by the transfer unit, and wherein a paper powder removal region from which the paper powder removal unit removes paper powder on the image carrier is set wider in a rotation axis direction of the image carrier than the charge target region.

26. The image forming apparatus according to claim 25, wherein the paper powder removal region is set wider in the rotation axis direction of the image carrier than a developing region on the image carrier to which the developing unit applies a developer.

27. The image forming apparatus according to claim 25, wherein the charging target region is set wider in the rotation axis direction of the image carrier than a developing region on the image carrier to which the developing unit applies a developer.

28. The image forming apparatus according to claim 25, wherein the paper powder removal region is set wider in the rotation axis direction of the image carrier than a transfer region on the image carrier in which a developer image is to be transferred by the transfer unit onto a sheet.

29. The image forming apparatus according to claim 25, wherein the charging target region is set wider in the rotation axis direction of the image carrier than a transfer region on the image carrier in which a developer image is to be transferred onto a sheet by the transfer unit, and wherein the transfer region is set wider in the rotation axis direction of the image carrier than a developing region on the image carrier to which the developing unit applies a developer.

30. The image forming apparatus according to claim 25, wherein the paper powder removal unit has a brush disposed opposite the image carrier, and removes paper powder adhering to the image carrier from the image carrier with the brush.

31. The image forming apparatus according to claim 25, wherein the developer is a positively charged toner.

32. The image forming apparatus according to claim 25, wherein the developer is a positively charged toner, and wherein the paper powder removal unit has a conductive brush disposed opposite the image carrier, and selectively removes paper powder adhering to the image carrier from the image carrier by maintaining a potential of the brush higher than a surface potential of the image carrier by applying a predetermined voltage to the brush.

* * * * *